US011131941B1

(12) United States Patent
Ando

(10) Patent No.: US 11,131,941 B1
(45) Date of Patent: Sep. 28, 2021

(54) MOVING MECHANISM AND IMAGE FORMING APPARATUS

(71) Applicant: TOSHIBA TEC KABUSHIKI KAISHA, Tokyo (JP)

(72) Inventor: Shunsuke Ando, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/114,618

(22) Filed: Dec. 8, 2020

(30) Foreign Application Priority Data

Mar. 6, 2020 (JP) ..... JP2020-039088

(51) Int. Cl.
*G03G 15/04* (2006.01)
*G03G 15/043* (2006.01)
*G03G 21/16* (2006.01)

(52) U.S. Cl.
CPC ..... *G03G 15/043* (2013.01); *G03G 15/04054* (2013.01); *G03G 21/1666* (2013.01)

(58) Field of Classification Search
CPC ..... G03G 15/043; G03G 15/04036; G03G 21/1647; G03G 21/1666; G03G 2215/0402; G03G 2221/1636
See application file for complete search history.

(56) References Cited

U.S. PATENT DOCUMENTS 10,877,431 B1 * 12/2020 Kodo ..... G03G 15/04054
2009/0052938 A1 2/2009 Sameshima et al.
2009/0052960 A1 * 2/2009 Tanaka ..... G03G 21/0011 399/358
2011/0299883 A1 * 12/2011 Suzuki ..... G03G 15/326 399/110
2014/0147166 A1 * 5/2014 Nakamura ..... G03G 21/1666 399/110
2017/0371292 A1 * 12/2017 Narita ..... G03G 15/04

FOREIGN PATENT DOCUMENTS

JP 2006-018126 1/2006
JP 2007-072321 3/2007
JP 2013-137425 7/2013
JP 2014-021156 2/2014

OTHER PUBLICATIONS

Extended European Search Report for European Patent Application No. 21157605.3 dated Jun. 23, 2021.

* cited by examiner

*Primary Examiner* — Thomas S Giampaolo, II
(74) *Attorney, Agent, or Firm* — Amin, Turocy & Watson, LLP

(57) ABSTRACT

An image forming apparatus including a photoreceptor unit, a first terminal, a stage, a first protrusion, a second protrusion, a slider, and an exposure device. The stage moves from a first position closer to the photoreceptor to a second position farther from the photoreceptor in a second direction than the first position so that the second terminal is fitted to the first terminal. The slider includes a first position regulation portion and a second position regulation portion at positions separated from each other in the third direction. A thickness of the first position regulation portion in the first direction is thinner than a thickness of the second position regulation portion in the first direction. The slider slides with the first protrusion between a base portion and the second protrusion and includes a guide portion. The exposure device is supported by the stage.

20 Claims, 21 Drawing Sheets

MOVING MECHANISM AND IMAGE FORMING APPARATUS

CROSS-REFERENCE TO RELATED APPLICATION

This application is based upon and claims the benefit of priority from Japanese Patent Application No. 2020-039088, filed on Mar. 6, 2020, the entire contents of which are incorporated herein by reference.

FIELD

Embodiments described herein relate generally to a moving mechanism and an image forming apparatus.

BACKGROUND

As an exposure light source of the image forming apparatus, for example, a line-type light source such as an LED array may be used. The line-type light source is held in an exposure device. Light emitted from the line-type light source is focused on a line by a lens included in the exposure device. The exposure device is supported by a moving mechanism which advances toward and retreats from a photoreceptor unit including a photoreceptor.

The moving mechanism moves the exposure device between an abutment position where the exposure device abuts on the photoreceptor unit and a separation position where the exposure device is separated from the photoreceptor unit. At the abutment position, the exposure device is positioned with respect to the photoreceptor so that the emitted light is focused at an exposure position on a surface of a photoreceptor drum.

For example, if a movement path in the moving mechanism varies due to a component error, an assembly error, or the like, positioning at the abutment position may be hindered.

DETAILED DESCRIPTION

Figure 1:
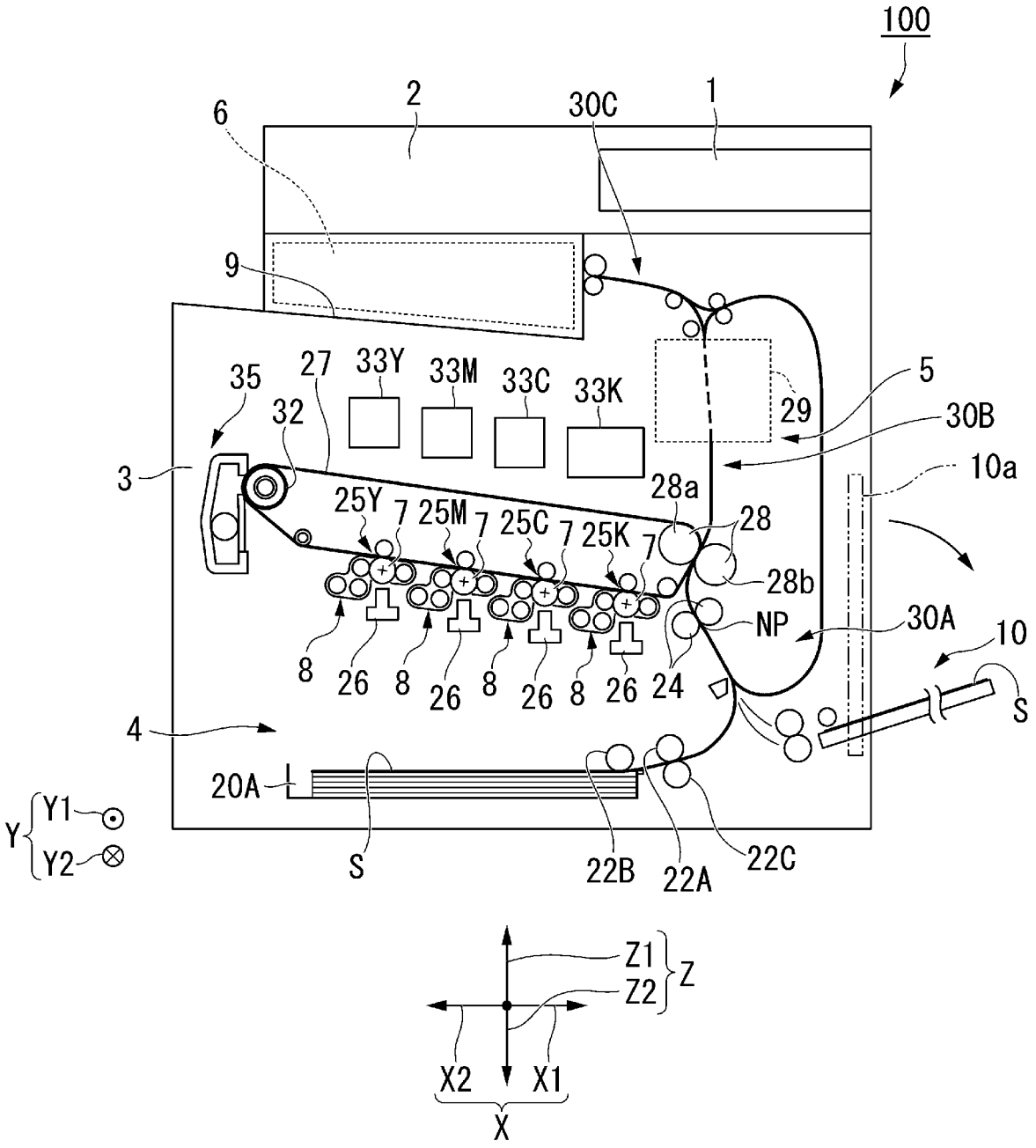
FIG. 1 is a schematic cross-sectional view illustrating a configuration example of an image forming apparatus of an embodiment.

Embodiments provide a moving mechanism and an image forming apparatus that facilitates positioning of a stage and an operation of the stage.

In general, according to one embodiment, there is provided an image forming apparatus including a photoreceptor unit, a first terminal, a stage, a first protrusion, a second protrusion, a slider, and an exposure device. The photoreceptor unit is configured to include a photoreceptor for carrying an electrostatic latent image. The first terminal is configured to be supported by the photoreceptor unit. The stage is configured to include a second terminal that fits with the first terminal and regulates a relative movement in a first direction with the photoreceptor. The stage is configured to be able to move from a first position closer to the photoreceptor to a second position farther from the photoreceptor in a second direction than the first position so that the second terminal is fitted to the first terminal. The first protrusion is configured to protrude from a base portion provided on the stage in a direction intersecting the second direction. The second protrusion is configured to protrude in a direction intersecting the first direction from the first protrusion at a position separated from the base portion in the first direction. The slider is configured to move in a third direction that intersects the second direction and the first direction. The slider is configured to include a first position regulation portion and a second position regulation portion at positions separated from each other in the third direction. The first position regulation portion regulates a position of the first protrusion in the second direction when the stage is in the first position. The second position regulation portion abuts on the first protrusion when the stage is in the second position. A thickness of the first position regulation portion in the first direction is thinner than a thickness of the second position regulation portion in the first direction. The slider is configured to slide with the first protrusion between the base portion and the second protrusion and include a guide portion which is long in the third direction between the second position regulation portion and the first position regulation portion. The exposure device is configured to be supported by the stage and to emit light to draw an electrostatic latent image on the photoreceptor.

Hereinafter, an image forming apparatus and a moving mechanism of the embodiment will be described with reference to the drawings. In the following figures, unless otherwise specified, the same or corresponding configurations are designated by the same reference numerals.

The image forming apparatus of the embodiment will be described.

FIG. 1 is a schematic cross-sectional view illustrating an overall configuration example of the image forming apparatus.

As illustrated in FIG. 1, an image forming apparatus 100 of the present embodiment includes a control panel 1, a scanner unit 2, a printer unit 3, a sheet supply unit 4, a conveyance unit 5, a manual feed unit 10, and a control unit 6.

Hereinafter, when referring to a relative position in the image forming apparatus 100, an X1 direction, an X2 direction, a Y1 direction, a Y2 direction, a Z1 direction, and a Z2 direction illustrated in the figure may be used. The X1 direction is a direction from left to right when standing in front of the image forming apparatus 100 (front side of the paper in FIG. 1). The X2 direction is opposite to the X1 direction. The Y1 direction is a direction from the back surface to the front surface of the image forming apparatus 100. The Y2 direction is opposite to the Y1 direction. The Z1 direction is a vertically upward direction. The Z2 direction is a vertically downward direction. When the X1 (Y1, Z1) direction and the X2 (Y2, Z2) direction are not intended to be distinguished from each other, or when both directions are included, the X1 (Y1, Z1) direction and the X2 (Y2, Z2) direction are simply described as the X (Y, Z) direction.

A plane having a normal line in the X direction is referred to as a YZ plane, a plane having a normal line in the Y direction is referred to as a ZX plane, and a plane having a normal line in the Z direction is referred to as an XY plane. The ZX plane is a plane parallel to a conveyance direction of a sheet S in the image forming apparatus 100. The XY plane is a horizontal plane.

Unless otherwise specified, a shape and disposition of each member of the image forming apparatus 100 will be described based on a state of being disposed in the image forming apparatus 100.

The control panel 1 operates the image forming apparatus 100 by being operated by a user.

The scanner unit 2 reads image information of an object to be copied based on brightness and darkness of light. The scanner unit 2 outputs the read image information to the printer unit 3.

The printer unit 3 forms an image on the sheet S based on the image information from the scanner unit 2 or the outside.

The printer unit 3 forms an output image (toner image) with a developer containing toner. The printer unit 3 transfers the toner image onto a surface of the sheet S. The printer unit 3 applies heat and pressure to the toner image on the surface of the sheet S to fix the toner image on the sheet S.

The sheet supply unit 4 supplies the sheet S one by one to the printer unit 3 according to the timing when the printer unit 3 forms the toner image.

The sheet supply unit 4 includes a paper feed cassette 20 and a cassette paper feed unit 21.

The paper feed cassette 20 accommodates sheets S of various sizes.

The cassette paper feed unit 21 is above an end portion of the paper feed cassette 20 in the X1 direction. The cassette paper feed unit 21 includes a pickup roller 22B, a paper feed roller 22A, and a separation roller 22C.

The pickup roller 22B conveys the sheet S required for image formation from the paper feed cassette 20 to a nip portion between the paper feed roller 22A and the separation roller 22C.

The paper feed roller 22A conveys the sheet S conveyed to the nip portion to the conveyance unit 5.

The separation roller 22C separates one sheet S when a plurality of sheets S are conveyed.

The conveyance unit 5 includes registration rollers 24.

The registration rollers 24 align a tip of the sheet S fed by the paper feed roller 22A at a nip NP. The registration rollers 24 convey the sheet S according to the timing when the printer unit 3 transfers the toner image to the sheet S. The registration rollers 24 convey the sheet S toward a transfer unit 28.

The printer unit 3 includes image forming units 25Y, 25M, 25C, and 25K, exposure units 26, an intermediate transfer belt 27, the transfer unit 28, a fixing device 29, and a transfer belt cleaning unit 35.

The image forming units 25Y, 25M, 25C, and 25K are arranged in this order in the X1 direction.

Each of the image forming units 25Y, 25M, 25C, and 25K forms a toner image to be transferred to the sheet S on the intermediate transfer belt 27.

The image forming units 25Y, 25M, 25C, and 25K each include a photoreceptor drum 7. The photoreceptor drum 7 includes a photosensitive layer on a surface thereof, and is an example of a photoreceptor for carrying an electrostatic latent image.

The image forming units 25Y, 25M, 25C, and 25K form a yellow, magenta, cyan, and black toner image on the photoreceptor drums 7, respectively, by developing the electrostatic latent image of each photoreceptor drum 7.

A charger, the exposure unit 26, a developing device 8, a primary transfer roller, a cleaning unit, and an electric neutralizer are disposed around each photoreceptor drum 7. The primary transfer roller faces the photoreceptor drum 7. The intermediate transfer belt 27 is sandwiched between the primary transfer roller and the photoreceptor drum 7.

Toner cartridges 33Y, 33M, 33C, and 33K are disposed above the image forming units 25Y, 25M, 25C, and 25K. The toner cartridges 33Y, 33M, 33C, and 33K contain yellow, magenta, cyan, and black toners, respectively.

The toners of the toner cartridges 33Y, 33M, 33C, and 33K are respectively supplied to the image forming units 25Y, 25M, 25C, and 25K by a toner supply tube (not illustrated).

Each exposure unit 26 irradiates the surface of each charged photoreceptor drum 7 with light. Light emission is controlled based on the image information. Each exposure unit 26 includes a light source in which a plurality of light emitting elements are arranged in the Y1 direction. In the example illustrated in FIG. 1, each exposure unit 26 is disposed below each of the image forming units 25Y, 25M, 25C, and 25K.

Image information corresponding to yellow, magenta, cyan, and black is supplied to the exposure units 26, respectively. Each exposure unit 26 forms an electrostatic latent image based on image information on the surface of each photoreceptor drum 7.

Figure 2:
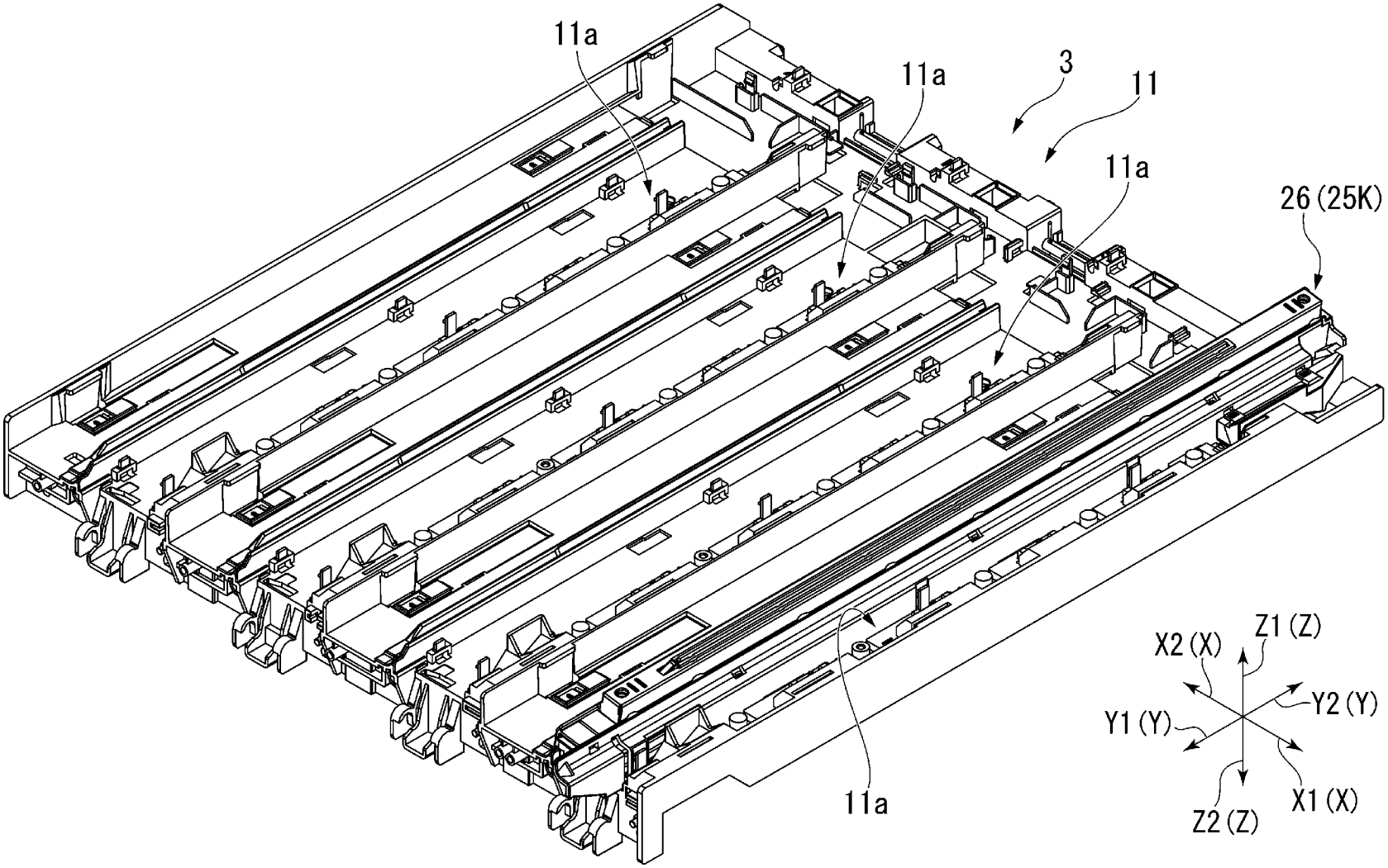
FIG. 2 is a schematic perspective view illustrating an exposure unit and a base portion in the image forming apparatus.

FIG. 2 is a schematic perspective view illustrating the exposure units and a base portion in the image forming apparatus.

As illustrated in FIG. 2 as an example of the exposure unit 26 in the image forming unit 25K, the exposure unit 26 is disposed on the base portion 11 provided in the printer unit 3.

The base portion 11 has four recesses 11*a* on which four exposure units 26 can be disposed. Each recess 11*a* is a groove long in the Y direction. Each recess 11*a* positions the bottom and sides of each exposure unit 26.

As illustrated in FIG. 1, the intermediate transfer belt 27 is an endless belt. Tension is applied to the intermediate transfer belt 27 by a plurality of rollers that are abutted on an inner peripheral surface thereof. The intermediate transfer belt 27 is stretched to be flat. The inner peripheral surface of the intermediate transfer belt 27 abuts on a support roller 28*a* at the most distant position in the X1 direction in a stretched direction. The inner peripheral surface of the intermediate transfer belt 27 abuts on a transfer belt roller 32 at the most distant position in the X2 direction in the stretched direction.

The support roller 28*a* forms a part of the transfer unit 28. The support roller 28*a* guides the intermediate transfer belt 27 to a secondary transfer position.

The transfer belt roller 32 guides the intermediate transfer belt 27 to a cleaning position.

On the lower surface side of the intermediate transfer belt 27 illustrated in the figure, the image forming units 25Y, 25M, 25C, and 25K excluding the primary transfer roller are disposed in this order in the X1 direction. The image forming units 25Y, 25M, 25C, and 25K are disposed to be spaced apart from each other in a region between the transfer belt roller 32 and the support roller 28*a*.

A transfer bias is applied to each of the primary transfer rollers of the image forming portions 25Y, 25M, 25C, and 25K when the toner image reaches the primary transfer position. Each primary transfer roller primarily transfers the toner image on the surface of each photoreceptor drum 7 onto the intermediate transfer belt 27.

In the intermediate transfer belt 27, the transfer unit 28 is disposed at a position adjacent to the image forming unit 25K.

The transfer unit 28 includes the support roller 28*a* and a secondary transfer roller 28*b*. The intermediate transfer belt 27 is sandwiched between the secondary transfer roller 28*b* and the support roller 28*a*. A position where the secondary transfer roller 28*b* and the intermediate hand transfer belt 27 abut on each other is the secondary transfer position.

The transfer unit 28 transfers a charged toner image on the intermediate transfer belt 27 onto the surface of the sheet S at the secondary transfer position. The transfer unit 28 applies the transfer bias to the secondary transfer position. The transfer unit 28 transfers the toner image on the intermediate transfer belt 27 onto the sheet S by the transfer bias.

The fixing device 29 applies heat and pressure to the sheet S. The fixing device 29 fixes the toner image transferred onto the sheet S by the heat and pressure. The fixing device 29 is disposed above the transfer unit 28.

The transfer belt cleaning unit 35 faces the transfer belt roller 32. The transfer belt cleaning unit 35 sandwiches the intermediate transfer belt 27. The transfer belt cleaning unit 35 scrapes off the toner on the surface of the intermediate transfer belt 27.

Between the registration roller 24 and the transfer unit 28, and between the transfer unit 28 and the fixing device 29, conveyance paths 30A and 30B for conveying the sheet S from a lower side to an upper side are formed in this order, respectively.

Each of the conveyance paths 30A, 30B, and 30C includes a conveyance guide portion and a conveyance roller that face each other with the sheet S in between.

The manual feed unit 10 supplies the sheet S on which the image is formed to the printer unit 3. If a manual feed tray 13 is used, the manual feed tray 13 is opened by being rotated clockwise as illustrated by the solid line. Sheets S of various sizes can be placed on the opened manual feed tray 13.

The manual feed unit 10 includes a pickup roller, a paper feed roller, and a separation roller similar to those of the sheet supply unit 4.

The control unit 6 controls the entire image forming apparatus 100 and each apparatus portion. For example, the control unit 6 controls the control panel 1, the scanner unit 2, the printer unit 3, the sheet supply unit 4, the conveyance unit 5, and the manual feed unit 10 to convey the sheet S and form an image on the sheet S.

As a device configuration of the control unit 6, for example, a processor such as a central processing unit (CPU) may be used.

The detailed configuration of each exposure unit 26 will be described. The configurations of the exposure units 26 are common to each other. In the following, if the image forming units 25Y, 25M, 25C, and 25K disposed above the exposure units 26 are not distinguished from each other, the image forming units 25Y, 25M, 25C, and 25K are referred to as an image forming unit 25.

Figure 3:
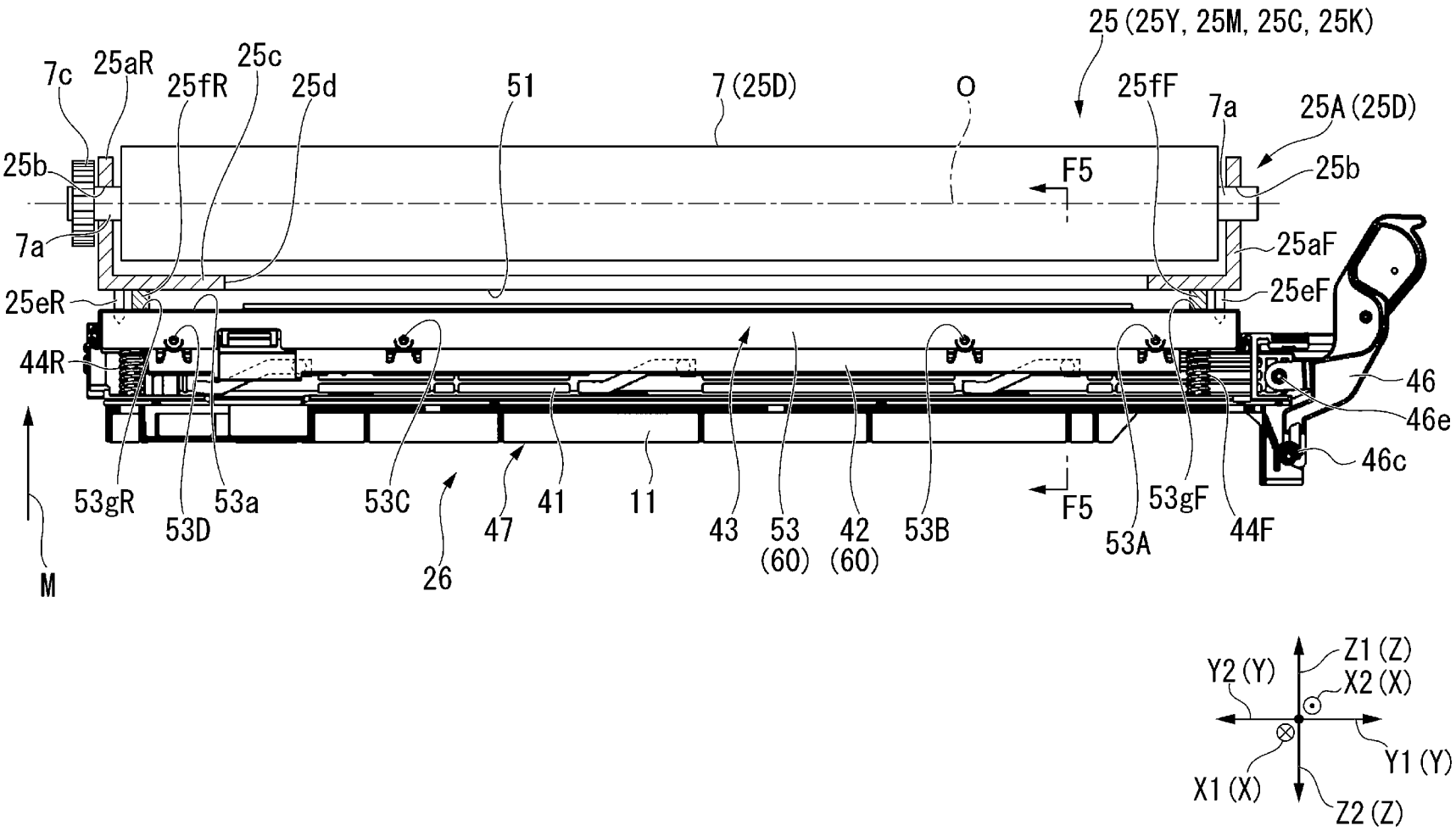
FIG. 3 is a schematic side view illustrating a photoreceptor, an exposure unit, and a moving mechanism in the image forming apparatus.
Figure 4:
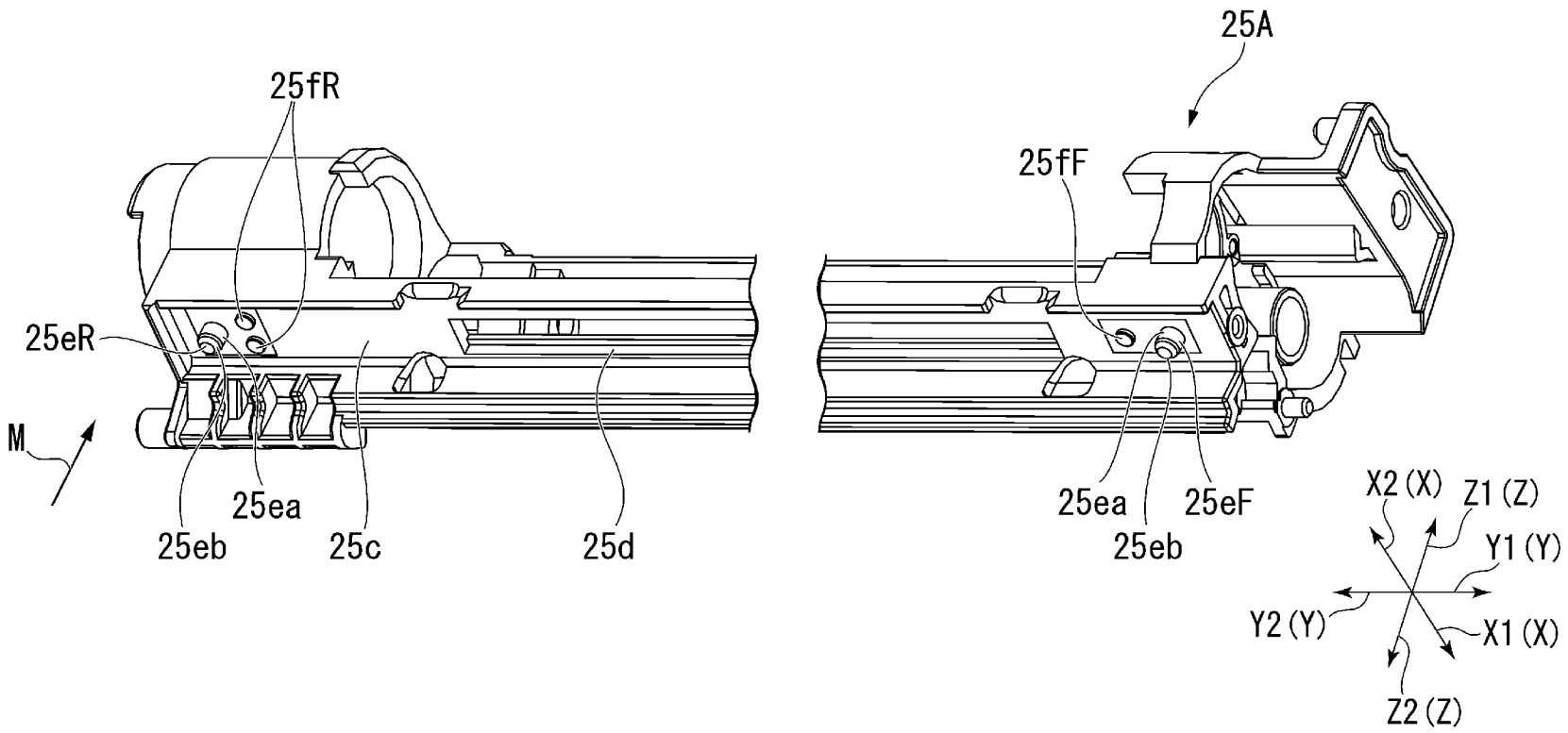
FIG. 4 is a schematic perspective view of a case accommodating the photoreceptor in the image forming apparatus.

FIG. 3 is a schematic side view illustrating the photoreceptor, the exposure unit, and the moving mechanism in the image forming apparatus of the embodiment. FIG. 4 is a schematic perspective view of the case accommodating the photoreceptor in the image forming apparatus.

As illustrated in FIG. 3, the image forming unit 25 includes a photoreceptor unit 25D including the photoreceptor drum 7 and a case 25A accommodating the photoreceptor drum 7. The exposure unit 26 in the image forming unit 25 includes an exposure device 43 and a moving mechanism 47. The exposure device 43 emits light to draw an electrostatic latent image on the photoreceptor drum 7. The moving mechanism 47 moves the exposure device 43 in the second direction between a second position and a first position.

For example, the second direction is an optical axis direction of light emitted from the exposure unit 26. The first position is a disposition position if the electrostatic latent image is formed on the photoreceptor drum 7 by light emitted from the exposure device 43. At the first position, in the second direction, the exposure unit 26 and the photoreceptor unit 25D abut on each other, so that the distance between the exposure device 43 and the photoreceptor drum 7 is kept constant. At the second position, in the second direction, the exposure unit 26 is separated from the photoreceptor unit 25D and a gap wider than that at the first position is formed between the exposure device 43 and the photoreceptor unit 25D.

The photoreceptor unit 25D can be pulled out in the Y1 direction with the exposure unit 26 left in the printer unit 3.

The photoreceptor drum 7 is long in the Y direction and has a rotation axis 7*a* at each of both ends in the Y direction. Each rotation axis 7*a* is coaxial with a central axis O parallel to the Y direction. A gear 7*c* is provided at the tip of the rotation axis 7*a* in the Y2 direction. A driving force for rotating the photoreceptor drum 7 is transmitted to the gear 7*c*.

The case 25A includes a bottom plate 25*c*, side plates 25*a*F and 25*a*R, abutment portions 25*f*F and 25*f*R, and first positioning portions 25*e*F and 25*e*R.

The first positioning portions 25*e*F and 25*e*R are examples of first terminals supported by the photoreceptor unit.

The bottom plate 25*c* is above the exposure unit 26. The bottom plate 25*c* is formed with an opening 25*d* that transmits light emitted upward from the exposure unit 26. For example, the opening 25*d* is a hole that penetrates the bottom plate 25*c* in the thickness direction and is long in the Y direction. For example, a shape of the opening 25*d* when viewed from the Z2 direction is a rectangular shape.

The side plate 25*a*F protruding in the Z1 direction is provided at the end of the bottom plate 25*c* in the Y1 direction. The side plate 25*a*R protruding in the Z1 direction is provided at the end of the bottom plate 25*c* in the Y2 direction. Bearing portions 25*b* that rotatably support the rotation axis 7*a* around the central axis O are provided on the side plates 25*a*F and 25*a*R, respectively.

As illustrated in FIG. 4, on the lower surface of the bottom plate 25*c*, at a portion separated from the opening 25*d* in the Y1 direction, the abutment portion 25*f*F and the first positioning portion 25*e*F are provided to be separated from each other in this order in the Y1 direction.

On the lower surface of the bottom plate 25*c*, at a portion separated from the opening 25*d* in the Y2 direction, two abutment portions 25*f*R and the first positioning portion 25*e*R are provided to be separated from each other in this order in the Y2 direction. The two abutment portions 25*f*R are adjacent to each other in the X direction.

The abutment portion 25*f*F and each abutment portion 25*f*R protrude below the lower surface of the bottom plate 25*c* along the normal line of the bottom plate 25*c*, respectively. In the present embodiment, the normal line of the bottom plate 25*c* is parallel to a second direction M in the moving direction of the exposure device 43. The distances between the tips of the abutment portion 25*f*F and each abutment portion 25*f*R in a protruding direction and the central axis O are equal to each other.

The shapes of the abutment portion 25*f*F and each abutment portion 25*f*R are not particularly limited as long as the distance between the exposure unit 26 and the photoreceptor drum 7 can be kept constant by being abutted on an upper plate 53*a* of the exposure unit 26. A contact form between the tips of the abutment portions 25*f*F and 25*f*R and the upper plate 53*a* may be point contact, line contact, or surface contact.

For example, the abutment portion 25*f*F and each abutment portion 25*f*R may have a columnar shape, a prismatic shape, a hemispherical shape, a plate shape, or the like. The tips of the abutment portion 25*f*F and each abutment portion 25*f*R may be a flat surface or curved surface.

For example, the abutment portion 25*f*F and each abutment portion 25*f*R may be a column whose tip is formed of a flat surface parallel to the central axis O.

The first positioning portions 25*e*F and 25*e*R are shaft members that protrude below the lower surface of the bottom plate 25*c* along the normal line of the bottom plate 25*c*, respectively. In the example illustrated in FIG. 4, the first positioning portions 25*e*F and 25*e*R are columns which are long in the second direction M and whose tips are tapered in a tapered shape. The first positioning portions 25*e*F and 25*e*R include a columnar portion 25*ea* and a tapered portion 25*eb*, respectively. Each of the columnar portions 25*ea* of the first positioning portions 25*e*F and 25*e*R protrude further than the tips of the abutment portions 25*f*F and 25*f*R in the protruding direction.

Figure 5:
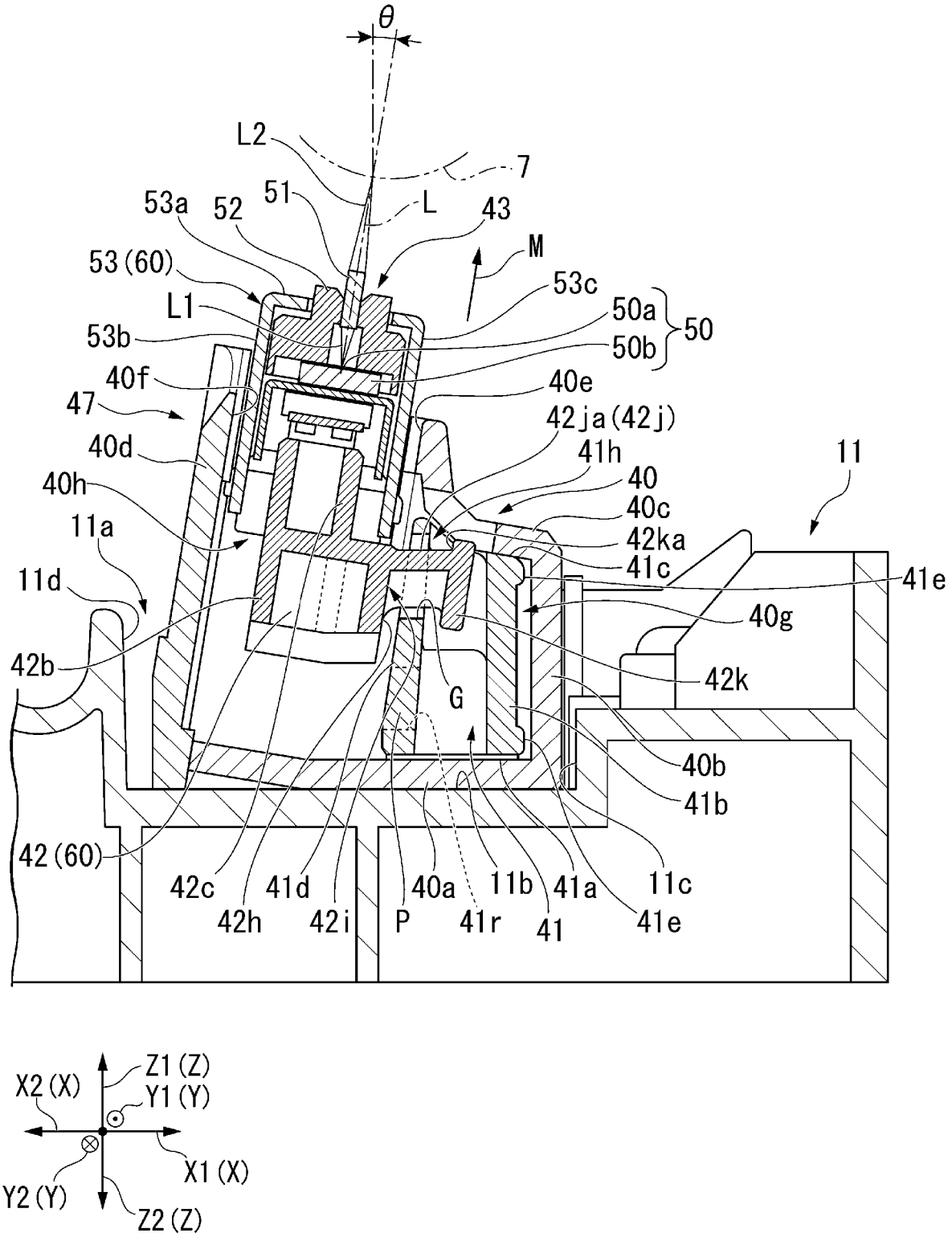
FIG. 5 is a schematic cross-sectional view taken along line F5-F5 in FIG. 3.
Figure 6:
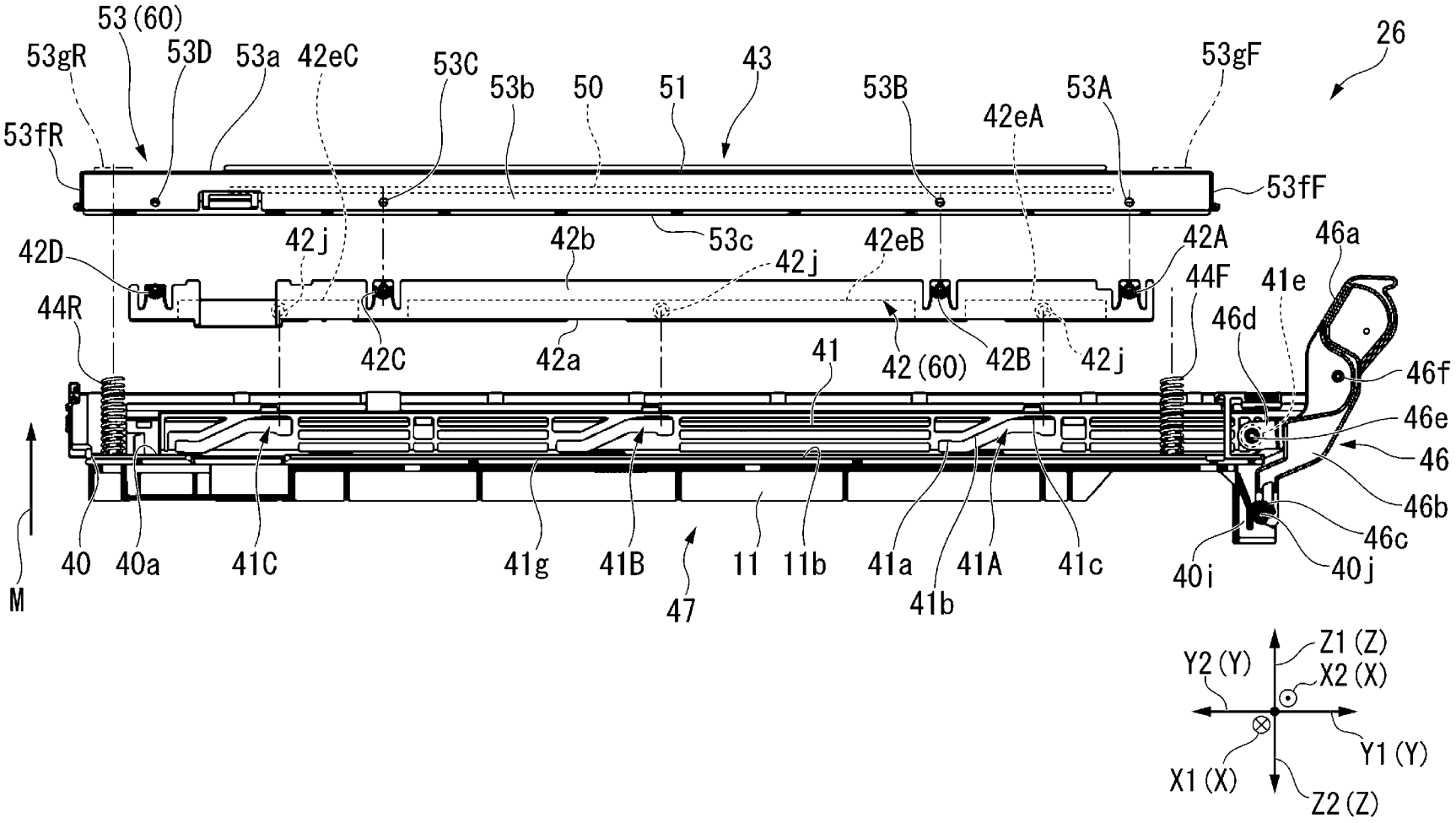
FIG. 6 is an exploded view of the exposure unit and the moving mechanism in the image forming apparatus.

FIG. 5 is a schematic cross-sectional view taken along line F5-F5 in FIG. 3. FIG. 6 is an exploded view of an exposure unit and a moving mechanism in the image forming apparatus of the embodiment.

As illustrated in FIG. 5, the exposure device 43 includes a light source 50, a lens 51, and a holder 52.

The light source 50 is long in the Y direction. As illustrated in FIG. 5, the light source 50 includes a plurality of light emitting elements 50*a* and a circuit board 50*b*. For example, the plurality of light emitting elements 50*a* is a solid light emitting element array. For example, the plurality of light emitting elements 50*a* are arranged in the longitudinal direction of the light source 50. The longitudinal direction of the light source 50 is the Y direction in the image forming apparatus 100.

For example, the plurality of light emitting elements 50*a* may be an LED array, an organic EL array, or the like.

The number of the plurality of light emitting elements 50*a* is equal to or greater than the number of pixels in a main scanning direction in image formation.

Each of the plurality of light emitting elements 50*a* emits light L1 according to a drive current supplied by the circuit board 50*b*.

The circuit board 50*b* turns on and off the plurality of light emitting elements 50*a* by controlling the drive currents for the plurality of light emitting elements 50*a* according to a control signal transmitted from the control unit 6.

Each lens 51 focuses light L1 diverged from each of the plurality of light emitting elements 50*a*, and forms light L2 that is converged in a spot shape at a focal position on an optical axis L. A type of the lens 51 is not particularly limited as long as light L1 from the plurality of light emitting elements 50*a* can be focused independently. For example, as the lens 51, a SELFOCK (registered trademark) lens array or the like may be used.

Optical axes L of lights L1 and L2 from the plurality of light emitting elements 50*a* are parallel to each other and are inclined by θ with respect to a vertical line in the ZX plane. An inclination direction of the optical axis L is the clockwise direction in FIG. 5.

If the exposure device 43 is in the first position, the focal position where each light L2 is focused is on the surface of the photoreceptor drum 7 mounted in the image forming apparatus 100.

An angle of incidence of the optical axis L of light L2 with respect to the photoreceptor drum 7 is not particularly limited.

The holder 52 is a resin member that holds the light source 50 and the lens 51. The holder 52 has an opening through which the lens 51 is inserted and a recess in which the light source 50 is disposed. For example, the lens 51 is glued at the opening. If the light source 50 is fixed in the recess, light emitting portions of the plurality of light emitting elements 50*a* are at front focal points of the lenses 51.

As illustrated in FIG. 6, the moving mechanism 47 includes a casing 40, a stage 60, urging members 44F and 44R, a slider 41, guide members 41A, 41B, and 41C, and an operation unit 46.

As illustrated in FIG. 5, the casing 40 accommodates the stage 60 and the slider 41 inside. The casing 40 is mounted in the recess 11*a* of the base portion 11. The casing 40 is placed on a bottom surface 11*b* of the recess 11*a*, and is sandwiched between a right side surface 11*c* and a left side surface 11*d* protruding from the bottom surface 11*b* in the Z1 direction. For example, the casing 40 is fitted and fixed to a fitting portion formed on the bottom surface 11*b*, a claw-shaped portion formed on the right side surface 11*c*, and a fitting portion formed on the left side surface 11*d*.

The casing 40 has a bottom surface portion 40*a*, a first side wall 40*b*, an upper cover portion 40*c*, and a second side wall 40*d*. The bottom surface portion 40*a*, the first side wall 40*b*, the upper cover portion 40*c*, and the second side wall 40*d* are longer in the Y direction than any of the exposure device 43, the stage 60, and the slider 41.

The bottom surface portion 40*a* supports the slider 41 to be slidable in the Y direction. The bottom surface portion 40*a* is placed on the bottom surface 11*b* in the recess 11*a*. A shape of an upper surface of the bottom surface portion 40*a* is not particularly limited as long as the slider 41 is slidably movable in the Y direction. For example, the upper surface of the bottom surface portion 40*a* may have a flat surface parallel to the XY plane. For example, the upper surface of the bottom surface portion 40*a* may have protrusions or ridges located on a plane parallel to the XY plane.

The upper surface of the bottom surface portion 40*a* in the present embodiment has an inclined surface whose normal line direction is the second direction M, at least in the portion where the urging members 44F and 44R are disposed.

The first side wall 40*b* extends in the Z1 direction from the end of the bottom surface portion 40*a* in the X1 direction along the right side surface 11*c* of the recess 11*a*. The slider 41 is disposed in close proximity to the bottom surface portion 40*a* on the X2 direction side of the first side wall 40*b*.

The upper cover portion 40*c* is an L-shaped plate-shaped portion on the ZX plane. The upper cover portion 40*c* is formed in a range that covers the upper surface of the slider 41 from above. An inclined surface 40*e* parallel to the second direction M and Y direction is formed at the end portion of the upper cover portion 40*c* in the X2 direction.

The second side wall 40*d* is a flat plate-shaped wall portion parallel to the second direction M and Y direction from the end of the bottom surface portion 40*a* in the X2 direction. The lower end portion of the second side wall 40*d* is adjacent to and close to the left side surface 11*d* of the recess 11*a*.

In the casing 40, a space 40*g* having a substantially trapezoidal cross section surrounded by the bottom surface portion 40*a*, the first side wall 40*b*, and the upper cover portion 40*c* is long in the Y direction. The slider 41 is inserted into the space 40*g*.

The upper surface of the bottom surface portion 40*a* on which the slider 41 is placed slidably supports the slider 41 in the Y direction. The lower surface of the upper cover portion 40*c* guides the upper surface of the slider 41 in the Y direction. The side surface of the first side wall 40*b* on the X2 direction side guides the side surface of the slider 41 on the X1 direction side in the Y direction.

The space 40*g* allows the slider 41 to move linearly in the Y direction.

In the casing 40, a distance between an inclined surface 40*f* on the X1 direction side of the second side wall 40*d* and the inclined surface 40*e* of the upper cover portion 40*c* is slightly wider than a width of the exposure device 43 in the direction orthogonal to the second direction M in the ZX plane. Between the inclined surfaces 40*f* and 40*e*, a space 40*h* is formed in which the exposure device 43 and a part of the stage 60 can move in the second direction M.

As illustrated in FIG. 6, at the end of the casing 40 in the Y1 direction, an attachment portion 40*i* protruding in the Z2 direction further than the bottom surface portion 40*a* is provided.

The attachment portion 40*i* is provided with a boss 40*j* for attaching the operating portion 46. The boss 40*j* protrudes in the X2 direction from a side portion of the attachment portion 40*i*.

The stage 60 includes a holding member 53 and a stay 42.

The holding member 53 holds the light source 50 and the lens 51 fixed to the holder 52. The material of the holding member 53 may be metal or resin. The holding member 53 may be made of a composite material of metal and resin. In the examples illustrated in FIGS. 5 and 6, the holding member 53 has a box shape in which a metal plate such as a mild steel plate or a stainless steel plate is bent.

As illustrated in FIGS. 5 and 6, the holding member 53 includes the upper plate 53*a*, a left side plate 53*b*, a right side plate 53*c* (see FIG. 5), a rear side plate 53*f*R (see FIG. 6), and a front side plate 53*f*F (see FIG. 6).

The upper plate 53*a* is a flat plate forming the upper surface of the holding member 53. The normal line of the upper plate 53*a* is parallel to the second direction M. The shape of the upper plate 53*a* when viewed from the second direction M is a rectangular shape long in the Y direction. As illustrated in FIG. 2, the upper plate 53*a* is longer than a length of the drum surface of the photoreceptor drum 7.

As illustrated in FIG. 5, an opening 53*d* is formed in the center of the upper plate 53*a* in the X direction. The upper end of the holder 52 holding the lens 51 is inserted into the opening 53*d*.

Figure 7:
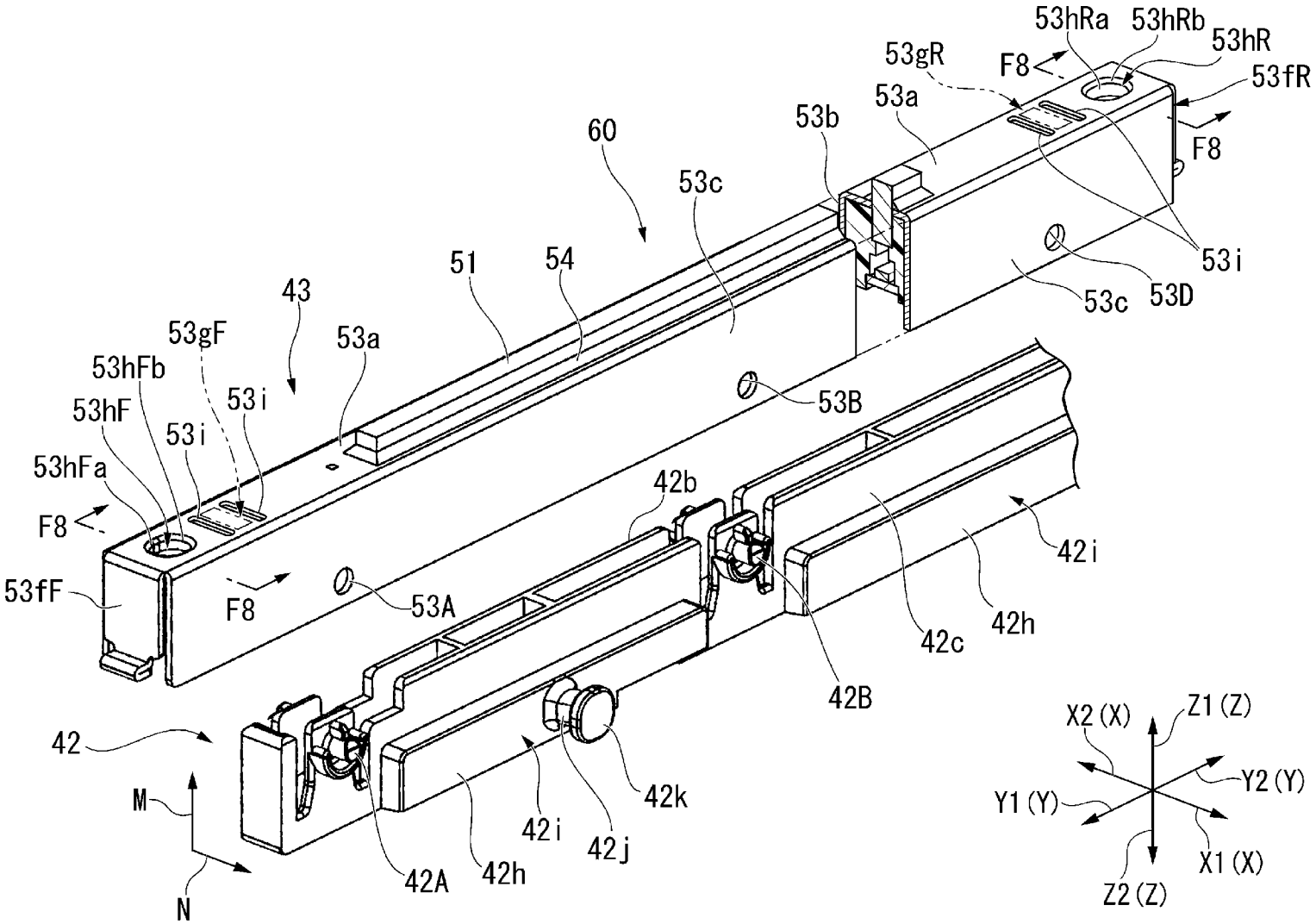
FIG. 7 is a schematic perspective view illustrating a stage in the image forming apparatus.
Figure 8:
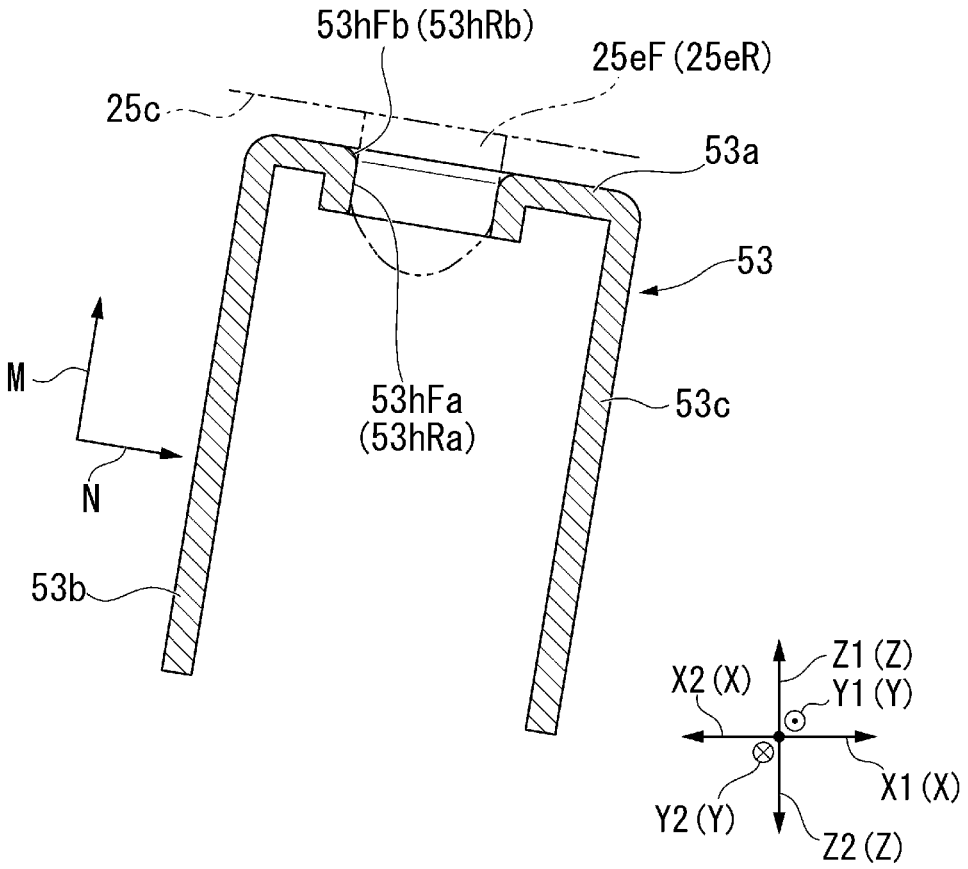
FIG. 8 is a schematic cross-sectional view taken along line F8-F8 in FIG. 7.
Figure 9:
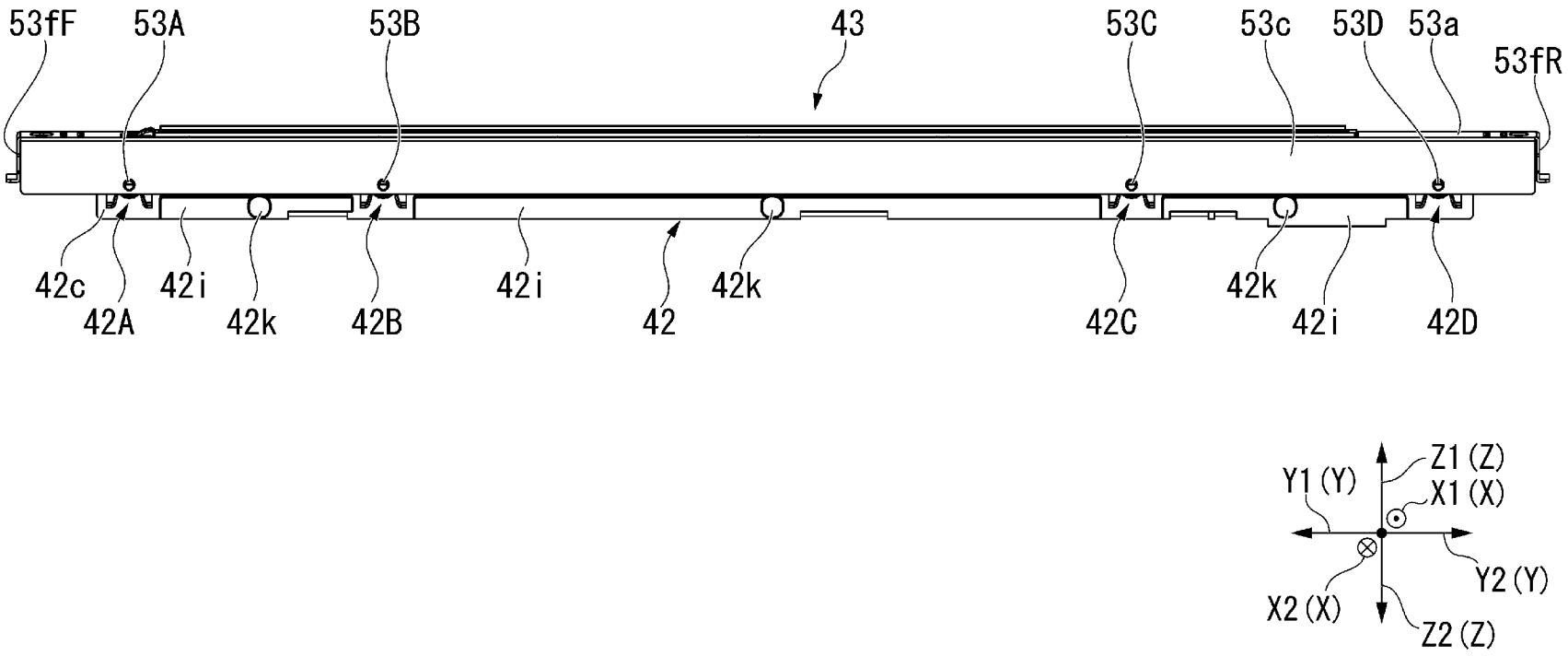
FIG. 9 is a schematic view of a right side view of the stage in the image forming apparatus.

FIG. 7 is a schematic perspective view illustrating a stage in the image forming apparatus of the embodiment. FIG. 8 is a schematic cross-sectional view taken along line F8-F8 in FIG. 7. FIG. 9 is a schematic view of the right side view of the stage in the image forming apparatus.

As illustrated in FIG. 7, the stage 60 includes second positioning portions 53*h*F and 53*h*R. The second positioning portions 53*h*F and 53*h*R are examples of second terminals that are fitted with the first terminals to regulate a relative movement with the photoreceptor in a first direction N.

Here, the first direction N is the direction from the left side plate 53*b* toward the right side plate 53*c* among the directions orthogonal to the second direction M and Y direction.

The second positioning portion 53*h*F is provided at an end portion of the upper plate 53*a* in the Y1 direction. The end portion of the upper plate 53*a* in the Y1 direction means the upper plate 53*a* in the range between the end of the upper plate 53*a* and the end of the lens 51 in the Y1 direction. In the example illustrated in FIG. 7, the second positioning portion 53*h*F is provided in a region close to the end of the upper plate 53*a* in the Y1 direction at the end portion of the upper plate 53*a* in the Y1 direction.

The second positioning portion 53*h*F and the first positioning portion 25*e*F of the case 25A can be fitted to each other in a concave-convex manner. In the present embodiment, the first positioning portion 25*e*F is a convex portion and the second positioning portion 53*h*F is a concave portion. The second positioning portion 53*h*F positions the first positioning portion 25*e*F in the Y direction. For example, the second positioning portion 53*h*F is fitted with the columnar portion 25*ea* of the first positioning portion 25*e*F so that the columnar portion 25*ea* can be inserted and removed. As illustrated in FIG. 8, the second positioning portion 53*h*F includes a cylindrically tubular portion 53*h*Fa extending in a direction opposite to the second direction M and a curved portion 53*h*Fb that smoothly curves along an arc-shaped curve from the upper end of the tubular portion 53*h*Fa toward the upper plate 53*a*. An inner diameter of the curved portion 53*h*Fb increases in a horn shape from the inner diameter of the tubular portion 53*h*Fa in the second direction M.

As illustrated in FIG. 7, the second positioning portion 53*h*R is provided at the end portion of the upper plate 53*a* in the Y2 direction. The end portion of the upper plate 53*a* in the Y2 direction means the upper plate 53*a* between the end of the upper plate 53*a* and the end of the lens 51 in the Y2 direction. In the example illustrated in FIG. 7, the second positioning portion 53*h*R is provided in a region close to the end of the upper plate 53*a* in the Y2 direction at the end portion of the upper plate 53*a* in the Y2 direction.

The second positioning portion 53*h*R and the first positioning portion 25*e*R of the case 25A can be fitted to each other in a concave-convex manner. In the present embodiment, the first positioning portion 25*e*R is a convex portion and the second positioning portion 53*h*R is a concave portion. The second positioning portion 53*h*R positions the first positioning portion 25*e*R in the X direction. For example, the second positioning portion 53*h*R is a long hole which is long in the Y direction. The second positioning portion 53*h*R has a lateral width that allows the columnar portion 25*ea* of the first positioning portion 25*e*R to be inserted and removed in the X direction, and a longitudinal width that is longer than the diameter of the columnar portion 25*ea* of the first positioning portion 25*e*R.

The second positioning portion 53*h*R includes an elongated cylindrical-shaped tubular portion 53*h*Ra extending in the direction opposite to the second direction M and a curved portion 53*h*Rb that smoothly curves along an arc-shaped curve from the upper end of the tubular portion 53*h*Ra toward the upper plate 53*a*. As illustrated in FIG. 8, the lateral width of the curved portion 53*h*Rb increases in a horn shape from the lateral width of the tubular portion 53*h*Ra in the second direction M, similarly to the curved portion 53*h*Fb. The same applies to the cross-sectional shape of the longitudinal width.

The second positioning portions 53*h*F and 53*h*R are separated from the light source 50 and sandwich the light source 50 in between, in the Y direction. The second positioning portions 53*h*F and 53*h*R position the holding member 53 in the Y direction and in the first direction N intersecting the Y direction with respect to the abutment portions 25*f*F and 25*f*R by being fitted with the first positioning portions 25*e*F and 25*e*R, respectively.

The first positioning portions 25*e*F and 25*e*R are provided on the photoreceptor unit 25D and can be fitted to the second positioning portions 53*h*F and 53*h*R of the stage 60 in a concave-convex manner at the first position to position the stage 60 in a direction intersecting the second direction M. In the present embodiment, the directions intersecting the second direction M are the lateral direction and the longitudinal direction of the upper plate 53*a* among the directions along the upper plate 53*a*.

The stage 60 can be moved from the first position closer to the photoreceptor to the second position farther from the photoreceptor in the second direction than the first position to fit the second terminal into the first terminal.

At the end portion of the upper plate 53*a* in the Y1 direction, an abutment portion 53*g*F against which the tip of the abutment portion 25*f*F can abut is provided next to the second positioning portion 53*h*F in the Y2 direction. The shape of the abutment portion 53*g*F is not particularly limited as long as the abutment portion 53*g*F can abut on the abutment portion 25*f*F. In the example illustrated in FIG. 7, the abutment portion 53*g*F is a planar surface of the upper plate 53*a* sandwiched between two slits 53*i* that are long in the X direction and separated from each other in the Y direction.

At the end of the upper plate 53*a* in the Y2 direction, an abutment portion 53*g*R to which the tip of the abutment portion 25*f*R can abut is provided next to the second positioning portion 53*h*R in the Y1 direction. The shape of the abutment portion 53*g*R is not particularly limited as long as the abutment portion 53*g*R can abut on the abutment portion 25*f*R. In the example illustrated in FIG. 7, an abutment portion 53*g*F is a planar surface of the upper plate 53*a* sandwiched between the two slits 53*i*, like the abutment portion 53*g*F.

If the abutment portions 53*g*F and 53*g*R abut on the abutment portions 25*f*F and 25*f*R, the holding member 53, the stage 60 including the holding member 53, and the exposure device 43 held by the stage 60 are respectively positioned at the first position.

As illustrated in FIG. 8, the left side plate 53*b* is bent from the end of the upper plate 53*a* in the X2 direction in the direction opposite to the second direction M.

The right side plate 53*c* is bent from the end of the upper plate 53*a* in the X1 direction in the direction opposite to the second direction M.

An outer shape of the left side plate 53*b* when viewed from the X1 direction is a rectangular shape long in the Y direction (see FIG. 6). The outer shape of the right side plate 53*c* when viewed from the X2 direction is a rectangular shape long in the Y direction similar to the left side plate 53*b* (see FIG. 9).

The rear side plate 53*f*R is bent in the Z2 direction from the end of the upper plate 53*a* in the Y2 direction. The length of the rear side plate 53*f*R in the Z direction is substantially equal to the length of the left side plate 53*b* in the Z direction.

The front side plate 53*f*F is bent in the Z2 direction from the end of the upper plate 53*a* in the Y1 direction. The length of the front plate 53*f*F in the Z direction is substantially equal to the length of the left plate 53*b* in the Z direction.

As illustrated in FIG. 6, holes 53A, 53B, 53C, and 53D penetrate through a portion near the lower end (end in the Z2 direction) of the left sideplate 53*b* in the thickness direction. The hole centers of the holes 53A, 53B, 53C, and 53D are on the same straight line parallel to the upper plate 53*a*.

As illustrated in FIG. 9, the holes 53A, 53B, 53C, and 53D penetrate through the right sideplate 53*c* in the thickness direction at the same positions as in the left side plate 53*b*.

The overall shape of the holding member 53 is a box shape in which the left side plate 53*b*, the rear side plate 53*f*R, the right side plate 53*c*, and the front side plate 53*f*F are erected on the outer edge of the upper plate 53*a*.

As illustrated in FIG. 6, the stay 42 is shorter than the holding member 53 and longer than the distance between the hole 53A and the hole 53D in the Y direction. The width of the upper part of the stay 42 in the X direction is a size that can be inserted inside the holding member 53. The stay 42 is connected to the holding member 53 with the upper part of the stay 42 inserted inside the holding member 53.

The stay 42 is made of resin, for example.

As illustrated in FIG. 7, the shape of the stay 42 is a plate shape long in the Y direction as a whole.

The stay 42 has side plate portions 42*b* and 42*c*. The side plate portions 42*b* and 42*c* are flat plates parallel to the second direction M and the Y direction. The side plate portions 42*b* and 42*c* are disposed in this order in the X1 direction, and face each other in the respective plate thickness directions. The side plate portions 42*b* and 42*c* are connected to each other in the facing direction by a plurality of ribs.

As illustrated in FIG. 6, on the side plate portion 42*b*, protrusions 42A, 42B, 42C, and 42D that are fitted from the inside into the holes 53A, 53B, 53C, and 53D in the left side plate 53*b*, respectively, protrude to the side opposite to the side plate portion 42*c* (see FIG. 7).

As illustrated in FIG. 9, on the side plate portion 42*c*, the protrusions 42A, 42B, 42C, and 42D that are fitted from the inside into the holes 53A, 53B, 53C, and 53D in the right side plate 53*c*, respectively, protrude to the side opposite to the side plate portion 42*b* (see FIG. 7). The shapes of the protrusions 42A, 42B, 42C, and 42D provided on the side plate portion 42*c* are the same as those of the protrusions 42A, 42B, 42C, and 42D provided on the side plate portion 42*b*, except for the protruding direction.

In the present embodiment, the protrusions 42A, 42B, 42C, and 42D are formed on the side plate portions 42*b* and 42*c* which are divided into pieced portion by slits formed in the vicinity thereof. The protrusions 42A, 42B, 42C, and 42D can be inserted inside the holding member 53 by elastic deformation of respective pieced portions. After insertion, the protrusions 42A, 42B, 42C, and 42D are respectively urged toward the holes 53A, 53B, 53C, and 53D by the elastic restoring force of the respective pieced portions, and are respectively fitted to the holes 53A, 53B, 53C, and 53D from the inside of the holding member 53.

The holding member 53 and the stay 42 are coupled each other by fitting the holes 53A, 53B, 53C, and 53D with the protrusions 42A, 42B, 42C, and 42D, respectively. When coupling, the protrusions 42A, 42B, 42C, and 42D do not protrude to the outside of the left side plate 53*b* and the right side plate 53*c*, or even if the protrusions 42A, 42B, 42C, and 42D protrude, the protrusion is very slight. For the sake of simplicity, the protrusions 42A, 42B, 42C, and 42D will be described below with an example in which the protrusions 42A, 42B, 42C, and 42D do not protrude to the outside of the left side plate 53*b* and the right side plate 53*c*.

The width of the stage 60 (hereinafter referred to as the lateral width) in the first direction N is narrower than the interval between the inclined surfaces 40*e* and 40*f*. The stage 60 is movable in the second direction M and the first direction N between the inclined surfaces 40*e* and 40*f* in the casing 40.

As illustrated in FIG. 7, on the surface of the sideplate portion 42*c* in the X1 direction, a step portion 42*i* long in the Y direction protrudes between the protrusions 42A and 42B adjacent to each other in the Y direction.

As illustrated in FIG. 9, on the surface of the sideplate portion 42*c* in the X1 direction, the step portions 42*i* long in the Y direction respectively protrude between the protrusions 42B and 42C and between the protrusions 42C and 42D, which are adjacent to each other in the Y direction. The range of the lateral width of each step portion 42*i* is from the lower end of the right side plate 53*c* coupled to the stay 42 to the lower end of the side plate portion 42*c*.

The protruding heights of the step portions 42*i* are equal to each other. As illustrated in FIG. 5, the surface of each step portion 42*i* in the protruding direction is substantially flush with the surface of the right side plate 53*c* on the X1 direction side.

As illustrated in FIG. 9, a side surface portion 42*h* formed in the protruding direction in each step portion 42*i* is provided with a first protrusion 42*j* in an intermediate portion in the longitudinal direction and the lateral direction. The side surface portion 42*h* is an example of a base portion provided on the stage 60.

As an example illustrated in FIG. 5, each first protrusion 42*j* protrudes from the side surface portion 42*h* in a direction intersecting the second direction M. In the present embodiment, each first protrusions 42*j* protrudes in the X1 direction. Each first protrusion 42*j* is inclined counterclockwise in FIG. 5 by an angle θ with respect to the normal line of the side surface portion 42*h* in the ZX plane.

The shape of the first protrusion 42*j* is not particularly limited as long as the upper surface can be slidably locked to the slider 41. For example, the first protrusion 42*j* may be a column, an elliptical column, a rod whose end face in the Z1 direction is rounded into a cylindrical surface shape, a polygonal pillar, or the like.

Figure 10:
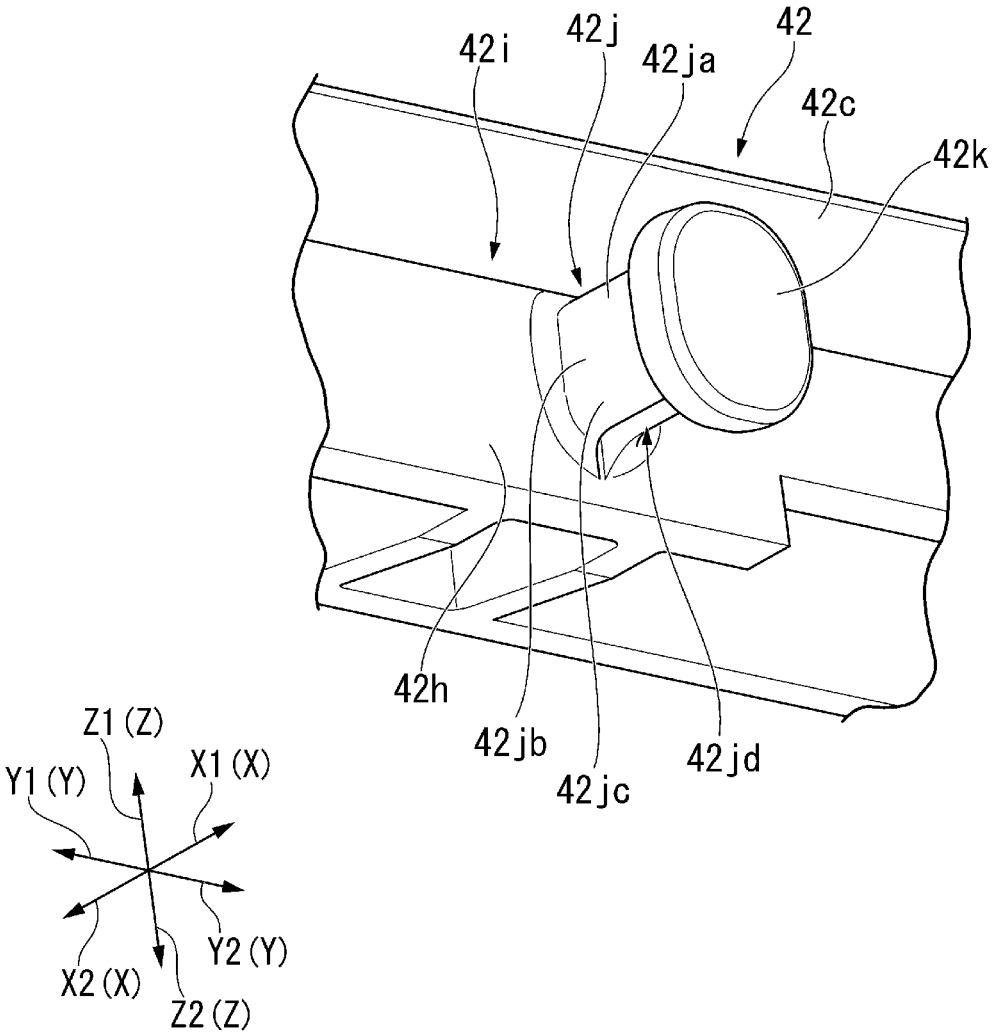
FIG. 10 is a schematic perspective view illustrating a first protrusion in the moving mechanism.

FIG. 10 is a schematic perspective view illustrating the first protrusion in the moving mechanism of the embodiment.

As illustrated in FIG. 10, the first protrusion 42*j* in the present embodiment has a first curved surface 42*ja*, side surfaces 42*jb*, a second curved surface 42*jc*, and a slit 42*jd*.

The first curved surface 42*ja* is the upper surface of the first protrusion 42*j*, and has a cylindrical surface shape in which an upwardly convex semicircle is extended in the X1 direction.

Each of the side surfaces 42*jb* extend in the Z1 direction from both lower ends of the first curved surface 42*ja*. Each side surface 42*jb* is a flat surface parallel to the ZX plane.

The second curved surface 42*jc* is the lower surface of the first protrusion 42*j*, and has a cylindrical surface shape in which a downwardly convex semicircle is extended in the X1 direction.

The slit 42*jd* is formed in the Z1 direction from the central portion of the second curved surface 42*jc*, and is a groove portion long in the X1 direction. The slit 42*jd* is provided to reduce an average wall thickness of the first protrusion 42*j*.

At the tip of the first protrusion 42*j* in the protruding direction, a second protrusion 42*k* protruding from the first protrusion 42*j* in the direction along the side surface portion 42*h* is provided.

The second protrusion 42*k* may protrude from at least one surface of the first protrusion 42*j* in the Z1 direction and the Z2 direction. The second protrusion 42*k* in the example illustrated in FIG. 10 has a flange shape that protrudes from the entire peripheral surface of the first protrusion 42*j*.

The second protrusion 42*k* has a plate shape having a substantially circular outer shape when viewed from the X2 direction. As illustrated in FIG. 5, a surface 42*ka* of the second protrusion 42*k* facing the step portion 42*i* side is a flat surface parallel to the side surface portion 42*h*.

As illustrated in FIG. 6, the urging members 44F and 44R are provided between the bottom surface portion 40*a* of the casing 40 and the holding member 53. The urging members 44F and 44R urge the holding member 53 in the second direction M.

The urging members 44F and 44R are not particularly limited as long as the holding member 53 can be urged in the second direction M. For example, elastic springs, elastic bodies, and the like may be used for the urging members 44F and 44R. In the example illustrated in FIG. 6, the urging members 44F and 44R are compression coil springs.

The urging member 44F urges the end portion of the holding member 53 in the Y1 direction from the back surface of the upper plate 53*a*. For example, the urging member 44F may urge the holding member 53 at a position overlapping the abutment portion 53*g*F in the second direction M.

The urging member 44R urges the end portion of the holding member 53 in the Y2 direction from the back surface of the upper plate 53*a*. For example, the urging member 44R may urge the holding member 53 at a position overlapping the abutment portion 53*g*R in the second direction M.

The slider 41 will be described.

Figure 11:
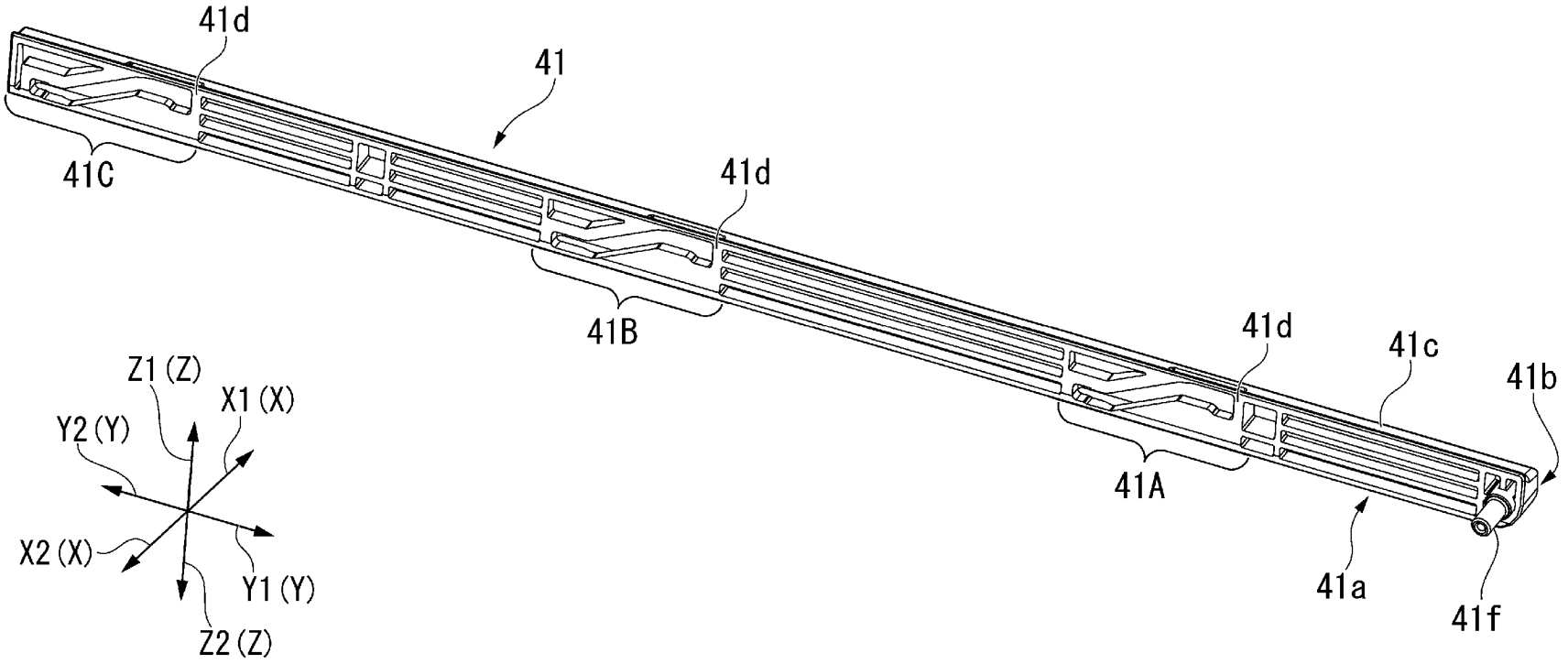
FIG. 11 is a schematic perspective view illustrating the entire slider in the moving mechanism.

FIG. 11 is a schematic perspective view illustrating the entire slider in the moving mechanism of the embodiment.

As illustrated in FIG. 11, the slider 41 has a thin plate shape in the X direction as a whole and is long in the Y direction.

As illustrated in FIG. 5, the cross section of the slider 41 parallel to the ZX plane is a substantially trapezoidal shape accommodated in the space 40*g* of the casing 40. The slider 41 is disposed next to the stay 42 in the X1 direction inside the space 40*g*.

The slider 41 has a bottom surface 41*a*, a side plate 41*b*, an upper surface portion 41*c*, and a side surface 41*d* on the outer peripheral portion.

The bottom surface 41*a* is a flat surface slidable in the Y direction. The bottom surface portion 40*a* is formed at a plurality of locations in the Y direction.

The side plate 41*b* extends in the Z1 direction along the first side wall 40*b* of the casing 40. Ridges 41*e* long in the Y direction are provided at the upper end and the lower end of the side plate 41*b*, respectively. Each ridge 41*e* can abut on the inner surface of the first side wall 40*b*. Each ridge 41*e* reduces sliding resistance of the slider 41 in the Y direction when the ridge 41*e* abuts on the first side wall 40*b*.

The upper surface portion 41*c* has a surface shape that can slide with the lower surface of the upper cover portion 40*c* of the casing 40 in the Y direction.

The side surface 41*d* forms an end face of the slider 41 in the X2 direction. The side surface 41*d* is an inclined surface inclined by an angle θ clockwise with respect to the YZ plane when viewed from the Y2 direction. The side surface 41*d* is formed at a position where the side surface 41*d* does not protrude in the X2 direction further than the same plane as the inclined surface 40*e* of the casing 40 in a movable range of the slider 41 in the X direction in the space 40*g*. The side surface 41*d* faces the side surface portion 42*h* and the right side plate 53*c* of the stage 60 with a gap in the X1 direction.

As illustrated in FIG. 11, a boss 41*f* that protrudes in the X2 direction further than the side surface 41*d* is provided at the end portion of the slider 41 in the Y1 direction. The operation unit 46 is attached to the boss 41*f*.

If an external force in the Y direction is applied to the boss 41*f* from the operation unit 46, the slider 41 can move in the Y direction in the casing 40.

The Y1 direction or the Y2 direction is an example of a third direction that intersects the second direction M and the X1 direction which is an example of the first direction.

The slider 41 includes the guide members 41A, 41B, and 41C on a part of the side surface 41*d*.

The guide members 41A, 41B, and 41C convert the movement of the slider 41 in the Y direction into the movement in the Z1 direction and transmit the movement to the first protrusions 42*j*.

The guide members 41A, 41B, and 41C are formed on the slider 41 at the same disposition intervals as those of the three first protrusions 42*j* on the stay 42.

Since the configurations of the guide members 41A, 41B, and 41C are the same as each other, the guide member 41A will be described below as an example.

Figure 12:
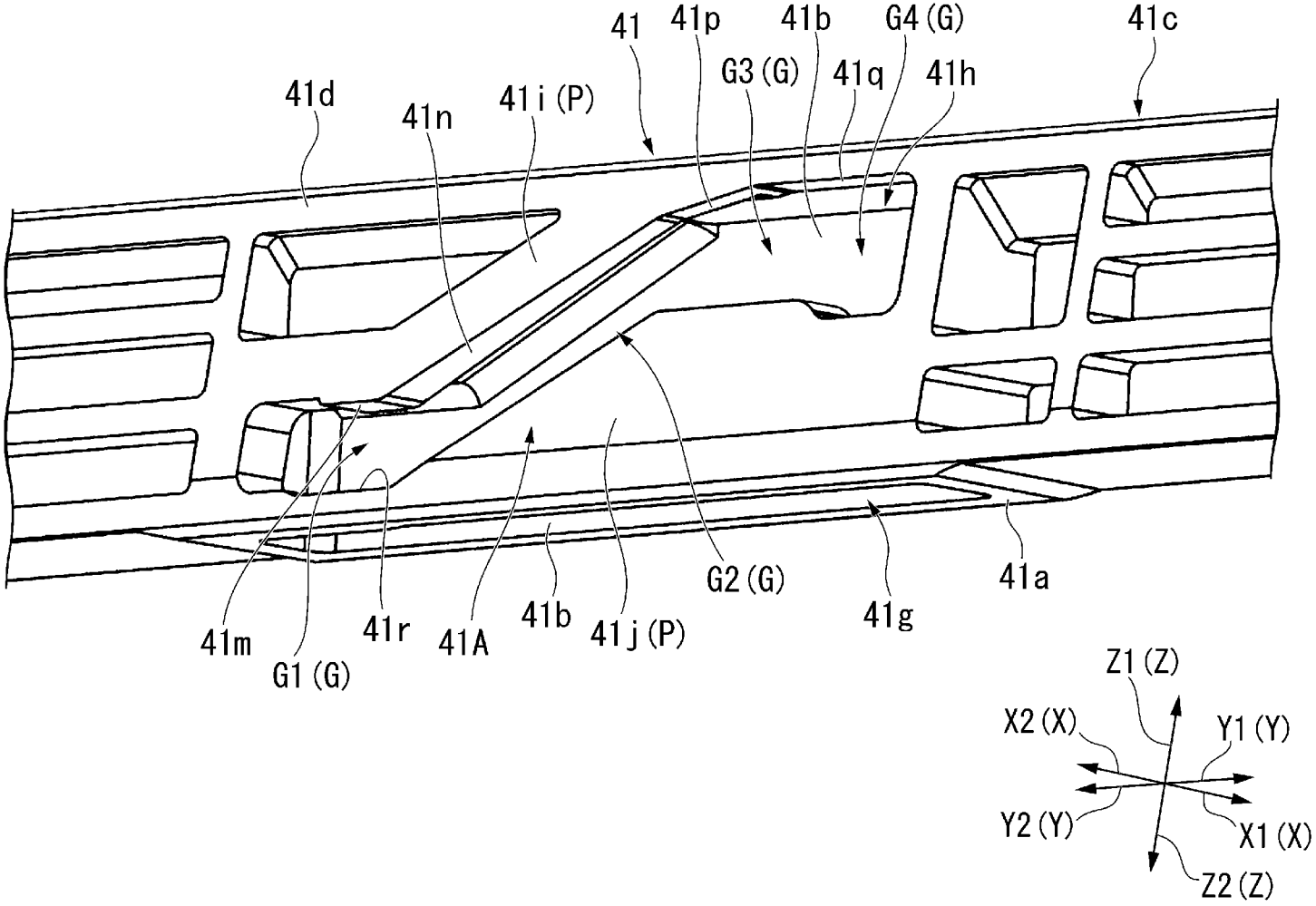
FIG. 12 is a schematic perspective view illustrating a main part of the slider in the moving mechanism.
Figure 13:
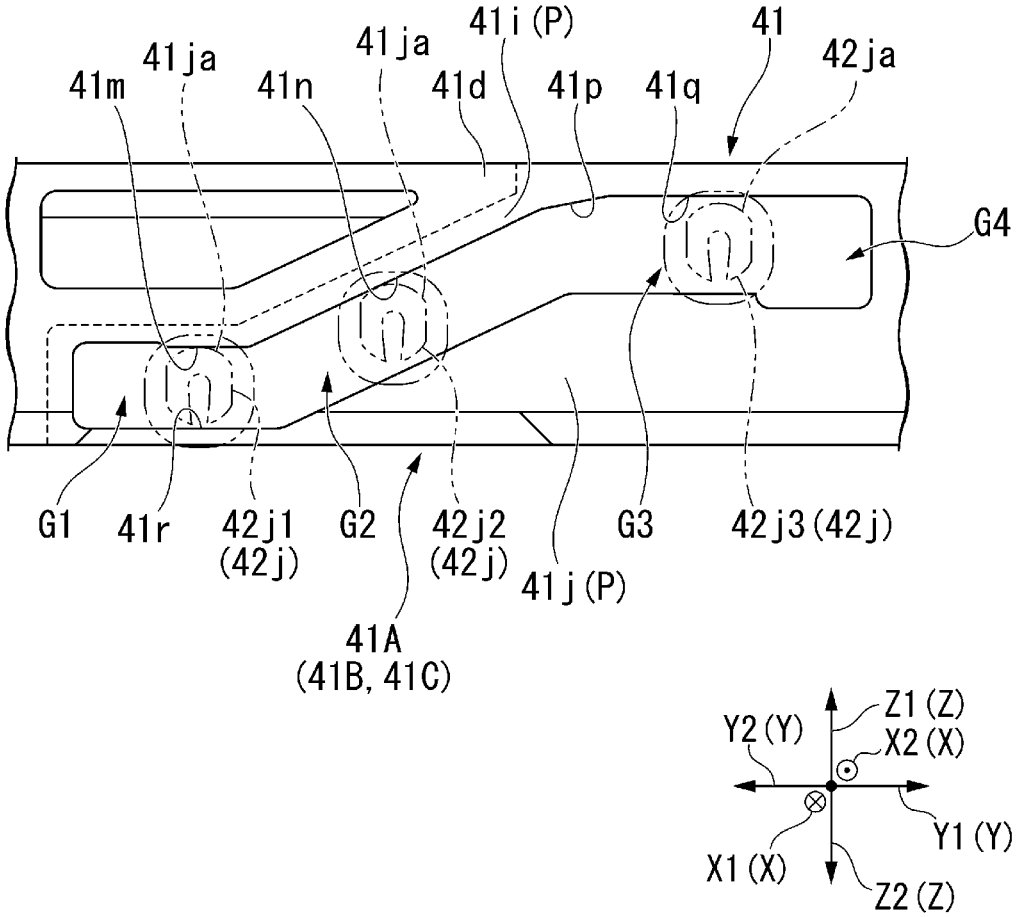
FIG. 13 is a schematic view of a left side view of a guide member in the moving mechanism.
Figure 14:
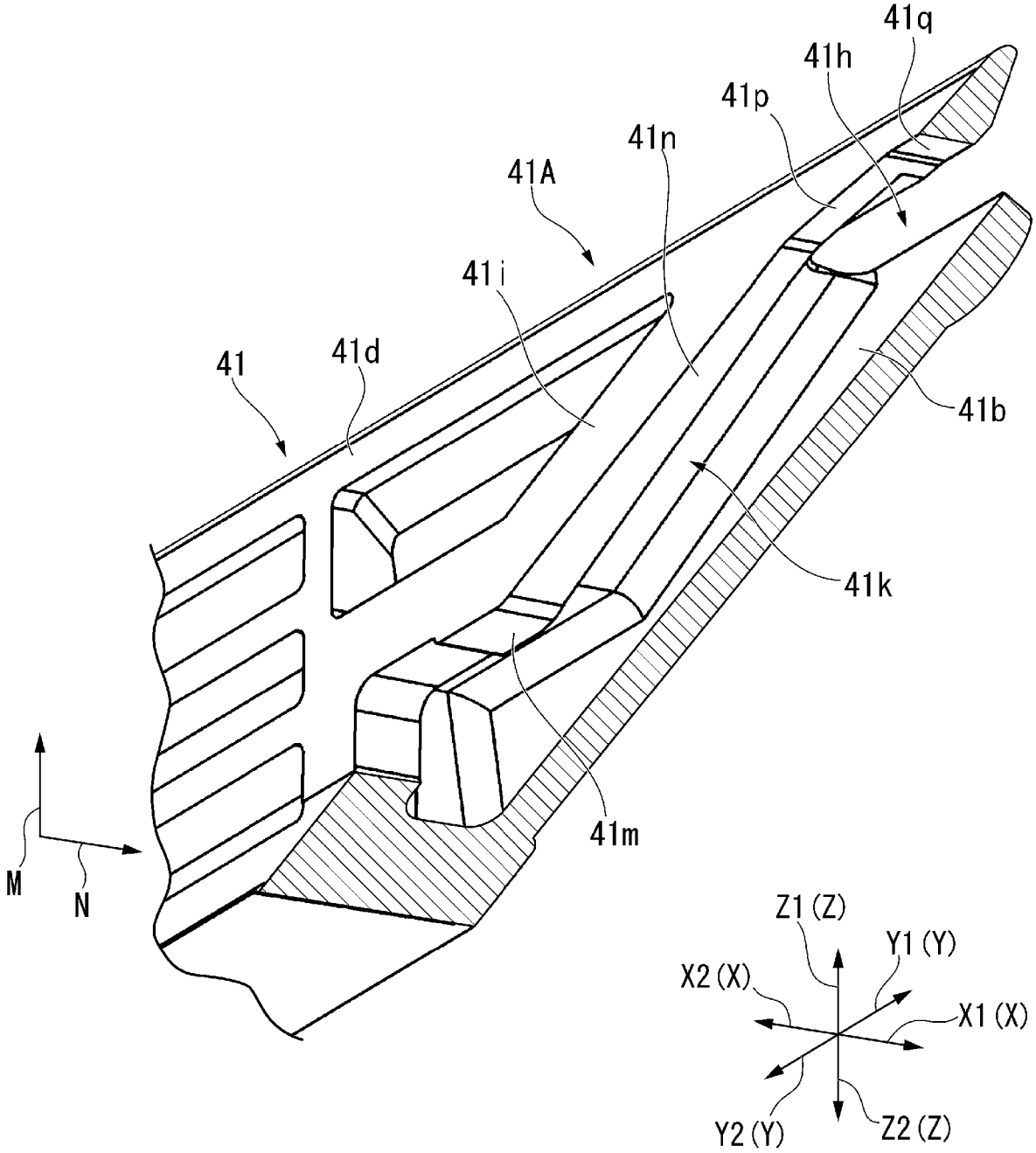
FIG. 14 is a schematic perspective view illustrating the guide member in the moving mechanism.

FIG. 12 is a schematic perspective view illustrating a main part of the slider in the moving mechanism of the embodiment. FIG. 13 is a schematic view of the left side view of the guide member in the moving mechanism. FIG. 14 is a schematic perspective view illustrating the guide member in the moving mechanism.

As illustrated in FIG. 12, the guide member 41A is disposed to face the side plate 41*b* in the X direction, and is configured with a plate P whose surface in the X2 direction forms the side surface 41*d*. A through-hole G penetrating in the X1 direction is formed in the plate P. The first protrusion 42*j* between the protrusions 42A and 42B is inserted into the through-hole G (see FIG. 5).

The plate P includes a first guide plate 41*i* on the Z1 direction side of the through-hole G and a second guide plate 41*j* on the Z2 direction side of the through-hole G. The edge of the first guide plate 41*i* in the Z2 direction forms the inner surface of the through-hole G in the Z1 direction. The edge of the second guide plate 41*j* in the Z1 direction forms the inner surface of the through-hole G in the Z2 direction.

As illustrated in FIG. 13, the through-hole G includes a first guide G1, a second guide G2, a third guide G3, and an insertion hole portion G4 when viewed from the X1 direction.

The first guide G1 is a hole portion of the guide member 41A from the end in the Y2 direction toward the Y1 direction. The inner surface in the first guide G1 in the Z1 direction is a locking portion 41*m* that locks the first protrusion 42*j* in the Z1 direction. The stage 60 is in the second position if the first protrusion 42*j* is locked to the locking portion 41*m*. The locking portion 41*m* also moves the stage 60 to the lowermost side in a movement range of the stage 60 in the second direction M.

The locking portion 41*m* is an example of a second position regulation portion that abuts on the first protrusion 42*j* if the stage 60 is in the second position.

In the present embodiment, the locking portion 41*m* is a flat surface parallel to the XY plane.

The inner surface of the first guide G1 in the Z2 direction is a lower surface 41*r* parallel to the locking portion 41*m*.

The second guide G2 is a hole portion that inclines toward the Z1 direction from the end of the first guide G1 in the Y1 direction in accompaniment to advancing in the Y1 direction. The inner surface of the second guide G2 in the Z1 direction is guide portions 41*n* and 41*p* that raise the position of the first protrusion 42*j*. The guide portion 41*n* is connected to the end of the locking portion 41*m* in the Y1 direction. The guide portion 41*p* is connected to the end of the guide portion 41*n* in the Y1 direction. The inclination of the guide portion 41*p* is smaller than the inclination of the guide portion 41*n*.

The guide portion 41*p* changes an ascending amount of the stage 60 when approaching the first position more gently than the guide portion 41*n*. If the stage 60 may be made to ascend at a constant rate from the second position to the first position, the guide portion 41*p* may be omitted.

The third guide G3 is a hole portion of the second guide G2 from the end in the Y1 direction toward the Y1 direction. The inner surface of the third guide G3 in the Z1 direction is a stopper surface 41*q* that regulates an ascending position of the first protrusion 42*j*. The stopper surface 41*q* is parallel to the XY plane.

The stopper surface 41*q* is an example of a first position regulation portion that regulates the position of the first protrusion 42*j* in the second direction M if the stage 60 is in the first position. The first position regulation portion and the second position regulation portion are separated from each other in the Y direction, which is the third direction from each other.

The insertion hole portion G4 is a hole portion from the end of the third guide G3 in the Y1 direction toward the end of the through-hole G in the Y1 direction.

The opening width of each of the first guide G1, the second guide G2, and the third guide G3 in the Z direction is wider than the width of the first protrusion 42*j* in the Z direction and narrower than the width of the second protrusion 42*k* in the Z direction.

The insertion hole portion G4 has an opening larger than the outer shape of the second protrusion 42*k*. The insertion hole portion G4 is used for inserting the second protrusion 42*k* into the through-hole G during manufacturing.

The length of the through-hole G in the Y direction is longer than a moving stroke of the slider 41 in the Y direction.

For example, if the slider 41 moves most in the Y1 direction, the first protrusion 42*j* faces the locking portion 41*m* in the Z direction, as illustrated by a first protrusion 42*j*1. A gap is formed between the first protrusion 42*j* locked with the locking portion 41*m* and the lower surface 41*r*.

For example, if the slider 41 moves most in the Y2 direction, the first protrusion 42*j* faces the stopper surface 41*q* in the Z direction, as illustrated by a first protrusion 42*j*3.

For example, if the slider 41 moves in the middle of the moving stroke, the first protrusion 42*j* faces the guide portion 41*n* in the Z direction, as illustrated by a first protrusion 42*j*2.

As illustrated in FIG. 12, the bottom surface 41*a* is provided on the Z2 direction side of the guide member 41A within a range similar to the length of the guide member 41A in the Y direction. At the center of the bottom surface 41*a*, a substantially rectangular lower opening 41*g* is formed when viewed from the Z1 direction.

The upper surface portion 41*c* is formed with an upper opening 41*h* that penetrates in a range that overlaps a part of the third guide G3 and the insertion hole portion G4 when viewed from the X1 direction.

If the stage 60 moves to the first position, the second protrusion 42*k* can enter the upper opening 41*h* (see FIG. 5).

As illustrated in FIG. 5, the thickness of the plate P decreases uniformly in accompaniment to advancing in the second direction M, at least above the lower surface 41*r* in the range where the through-hole G is formed. The plate thickness of the plate P is the thickest at a height or less of the lower surface 41*r* and the minimum at the upper end of the plate P.

For example, as illustrated in FIG. 14, the plate thickness of the guide portions 41*n* and 41*p* in the X1 direction uniformly decreases from the plate thickness of the locking portion 41*m* in accompaniment to advancing in the second direction M.

In the gap between the first guide plate 41*i* and the side plate 41*b* and the gap between the second guide plate 41*j* and the side plate 41*b*, the plate thickness increases uniformly in accompaniment to advancing in the second direction M.

Since the plate P has such a plate thickness, the thickness of the stopper surface 41*q* in the first direction N is thinner than the thickness of the locking portion 41*m*.

The slider 41 is made of resin. A decrease rate of the plate thickness of the plate P is larger than the reduction rate based on an average draft of the slider 41.

As illustrated in FIG. 6, the operation unit 46 advances and retreats the slider 41 in the Y direction with respect to the casing 40. For example, the operation unit 46 is a lever that rotates along the YZ plane.

The operation unit 46 includes an elongated lever body 46*b* and a link 46*d* that connects the lever body 46*b* to the slider 41.

A first end portion of the lever body 46*b* in the length direction is rotatably connected to the tip of the boss 40*j* of the casing 40 via a rotating joint 46*c*. The rotating joint 46*c* rotatably supports the lever body 46*b* around the central axis of the boss 40*j*. The central axis of the boss 40*j* is parallel to the X direction.

A grip portion 46*a* that can be gripped by a user is provided at a second end portion opposite to the first end portion in the length direction of the lever body 46*b*.

A rotating joint 46*f* that connects to the link 46*d* is provided between the first end portion and the second end portion in the length direction of the lever body 46*b*.

The first end portion of the link 46*d* in the length direction is rotatably connected to the lever body 46*b* via the rotating joint 46*f*.

The second end portion opposite to the first end portion in the length direction of the link 46*d* is rotatably connected to the tip of the boss 41*f* of the slider 41 via a rotating joint 46*e*.

The link 46*d* can rotate relative to the lever body 46*b* around the rotating joint 46*f*, with respect to the lever body 46*b* that rotates around the rotating joint 46*c*.

The operation of the moving mechanism 47 in the image forming apparatus 100 will be described focusing on actions of the guide members 41A, 41B, and 41C.

The stage 60 can be made to ascend and descend by the moving mechanism. 47 with respect to the casing 40 in the second direction M.

As illustrated in FIG. 3, if the operation unit 46 is erected and the rotating joint 46*e* is substantially directly above the rotating joint 46*c*, the holding member 53 of the stage 60 abuts on the abutment portions 25*f*F and 25*f*R at the abutment portions 53*g*F and 53*g*R. The stage 60 is in the first position. At the first position, a posterior focal point of the lens 51 is on the surface of the photoreceptor drum 7.

The holding member 53 presses the abutment portions 25*f*F and 25*f*R in the second direction M by the urging force from the urging members 44F and 44R.

Figure 15:
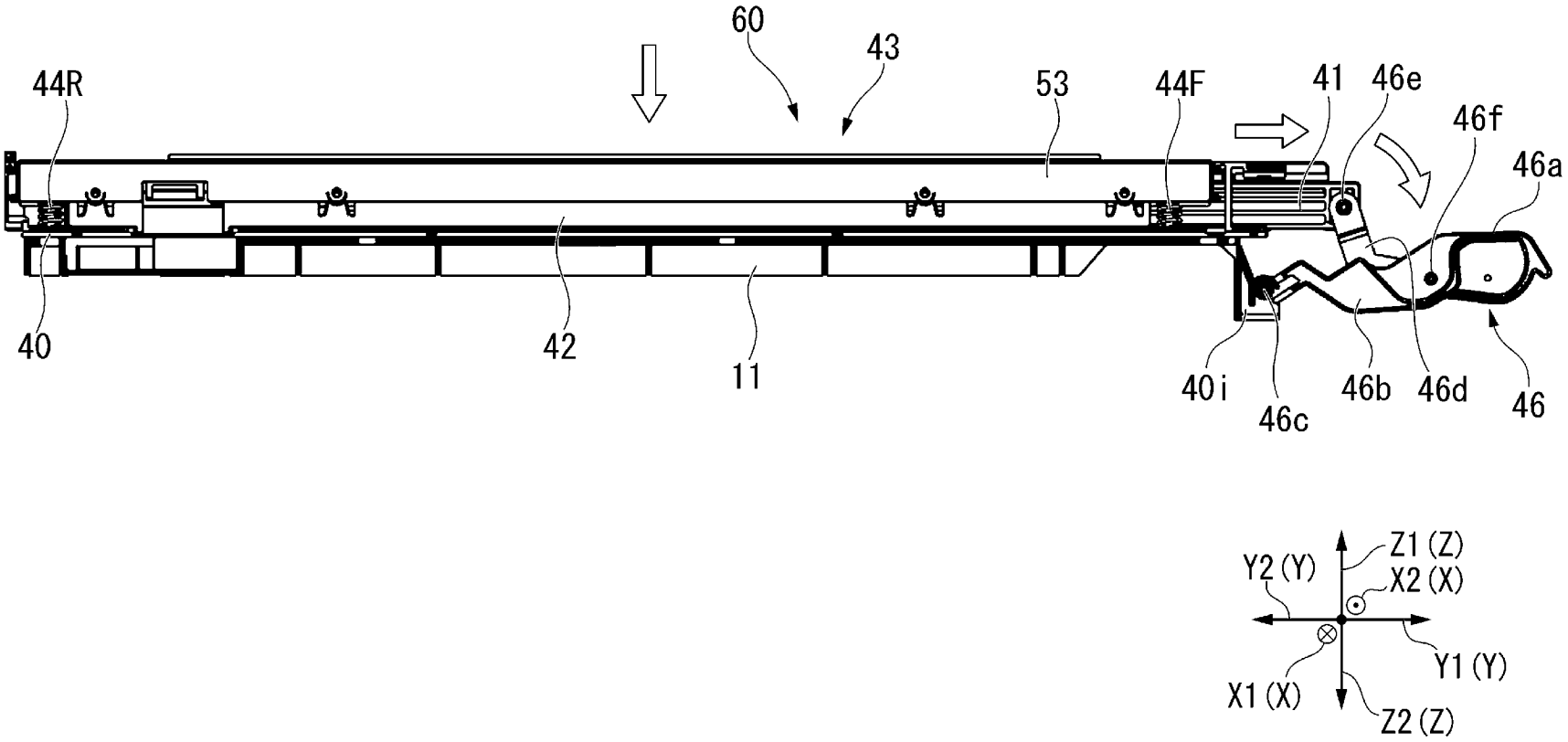
FIG. 15 is a schematic view of a left side view illustrating the exposure unit and the moving mechanism when descending in the image forming apparatus.

FIG. 15 is a schematic view of the left side view illustrating the exposure unit and the moving mechanism if descending in the image forming apparatus of the embodiment.

As illustrated in FIG. 15, when the lever body 46*b* rotates clockwise as illustrated from an erected state, the slider 41 moves in the Y1 direction. The stage 60 descends in the second direction M together with the slider 41. The stage 60 is in the second position. At the second position, the holding member 53 is separated from the abutment portions 25*f*F and 25*f*R by the moving mechanism 47 against the urging force of the urging members 44F and 44R.

The switching operation between the second position and the first position by the moving mechanism 47 will be described in detail.

Figure 16A:
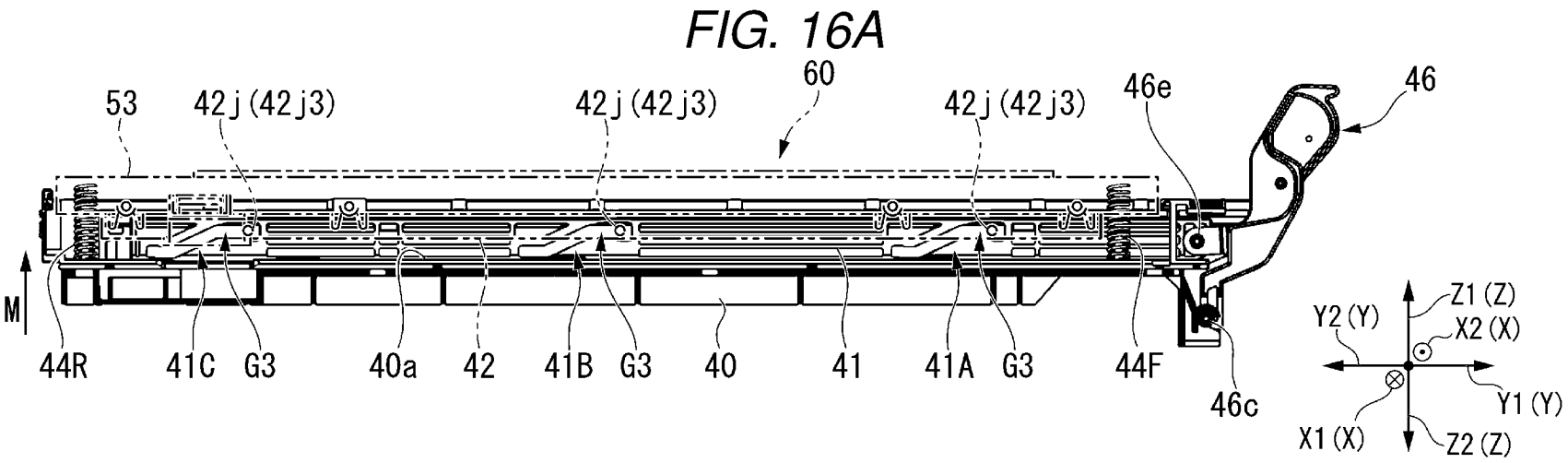
FIG. 16A and FIG. 16B are schematic diagrams illustrating an operation of the moving mechanism in the image forming apparatus.
Figure 16B:
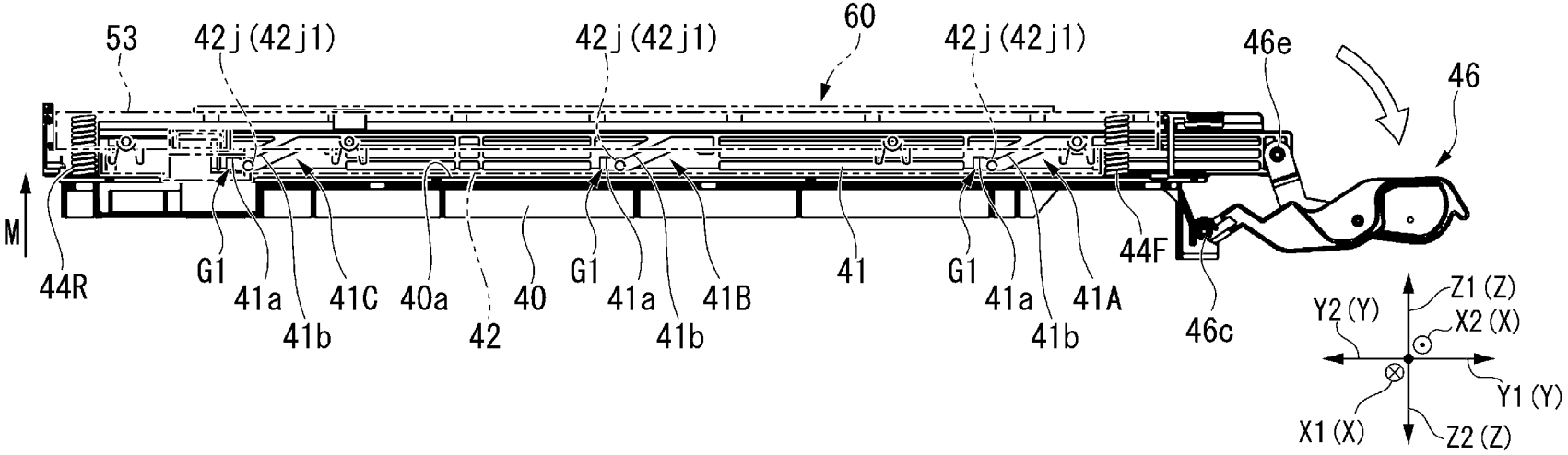

FIG. 16 is a schematic diagram illustrating the operation of the moving mechanism in the image forming apparatus. FIG. 16 is a schematic view illustrating a force acting on a stay in the image forming apparatus. In FIG. 16, (a) illustrates a case of the first position, and (b) illustrates a case of the second position.

As illustrated in (a) of FIG. 16, at the first position, the stay 42 is moved in the Y2 direction by the erected operation unit 46. Since the guide members 41A, 41B, and 41C are also moving in the Y2 direction together with the stay 42, each of the first protrusions 42*j* is located inside the third guide G3 like the first protrusion 42*j*3 illustrated in FIG. 13.

As illustrated in (b) of FIG. 16, at the second position, the stay 42 is moved in the Y1 direction by the operation unit 46 that is rotated clockwise and oriented horizontally. Since the guide members 41A, 41B, and 41C also move in the Y1 direction together with the stay 42, each of the first protrusions 42*j* abuts on the guide portion 41*n* and is pressed by the guide portion 41*n* in the direction opposite to the second direction M.

Each first protrusion 42*j* moves to the first guide G1 lower than the third guide G3 while being guided by the guide portion 41*n*. In the first guide G1, each first protrusion 42*j* abuts on the locking portion 41*m* and is pressed by the locking portion 41*m* in the direction opposite to the second direction M.

An ascending operation of the moving mechanism 47 will be described in a cross section parallel to the ZX plane.

Figure 17:
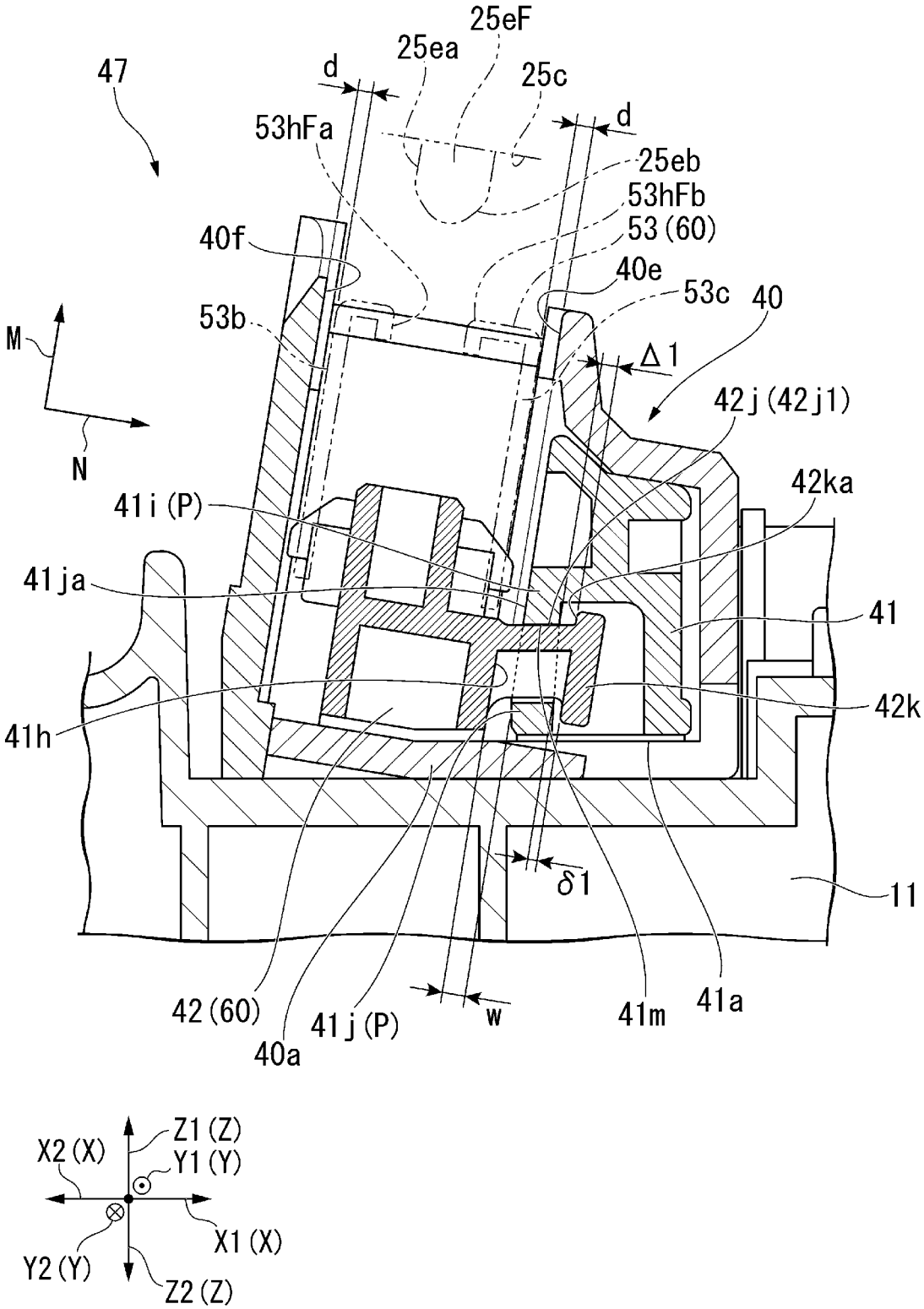
FIG. 17 is a schematic view illustrating an ascending and descending operation of a stage of the moving mechanism.
Figure 18:
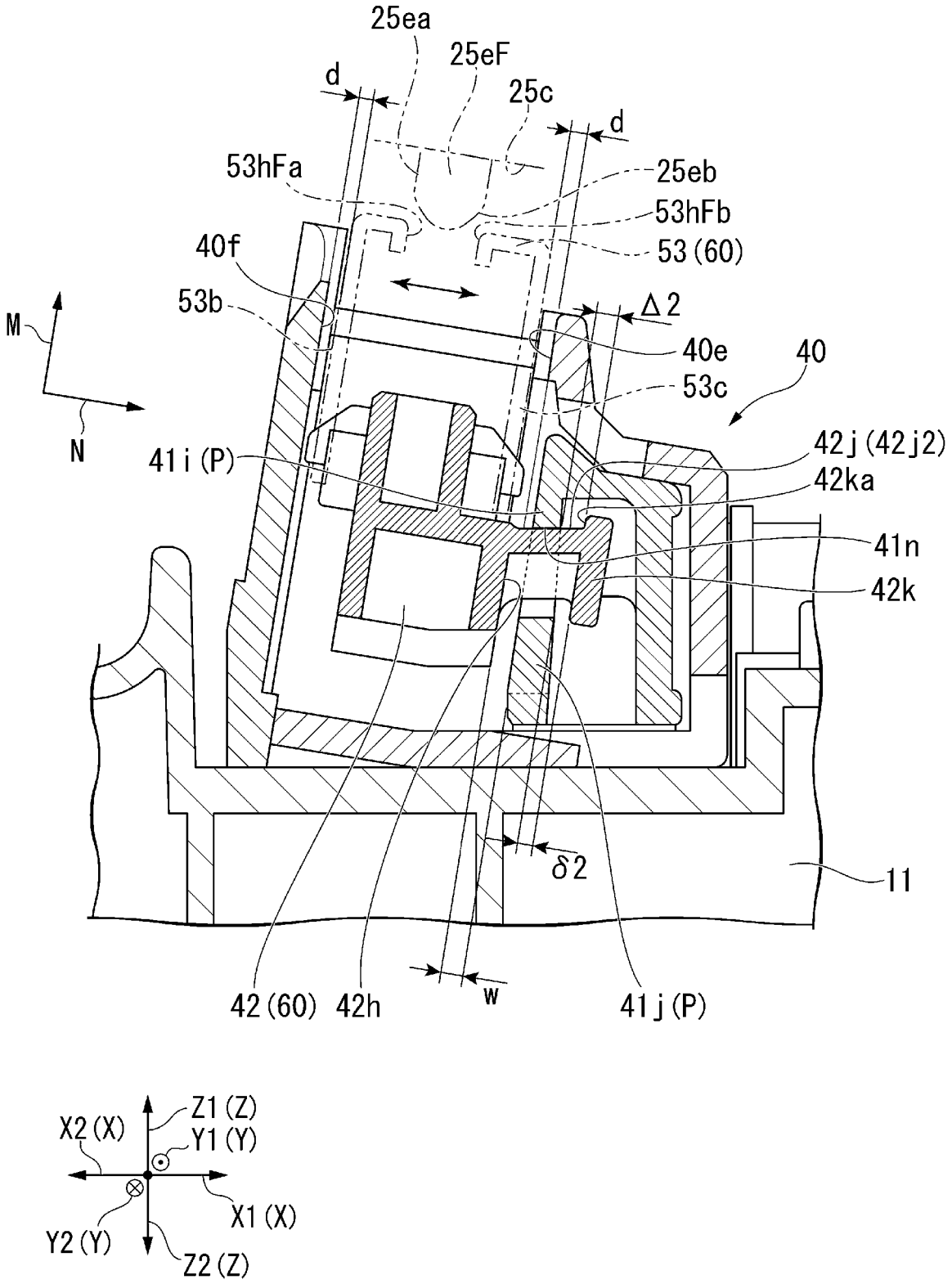
FIG. 18 is another schematic view illustrating the ascending and descending operation of the stage of the moving mechanism
Figure 19:
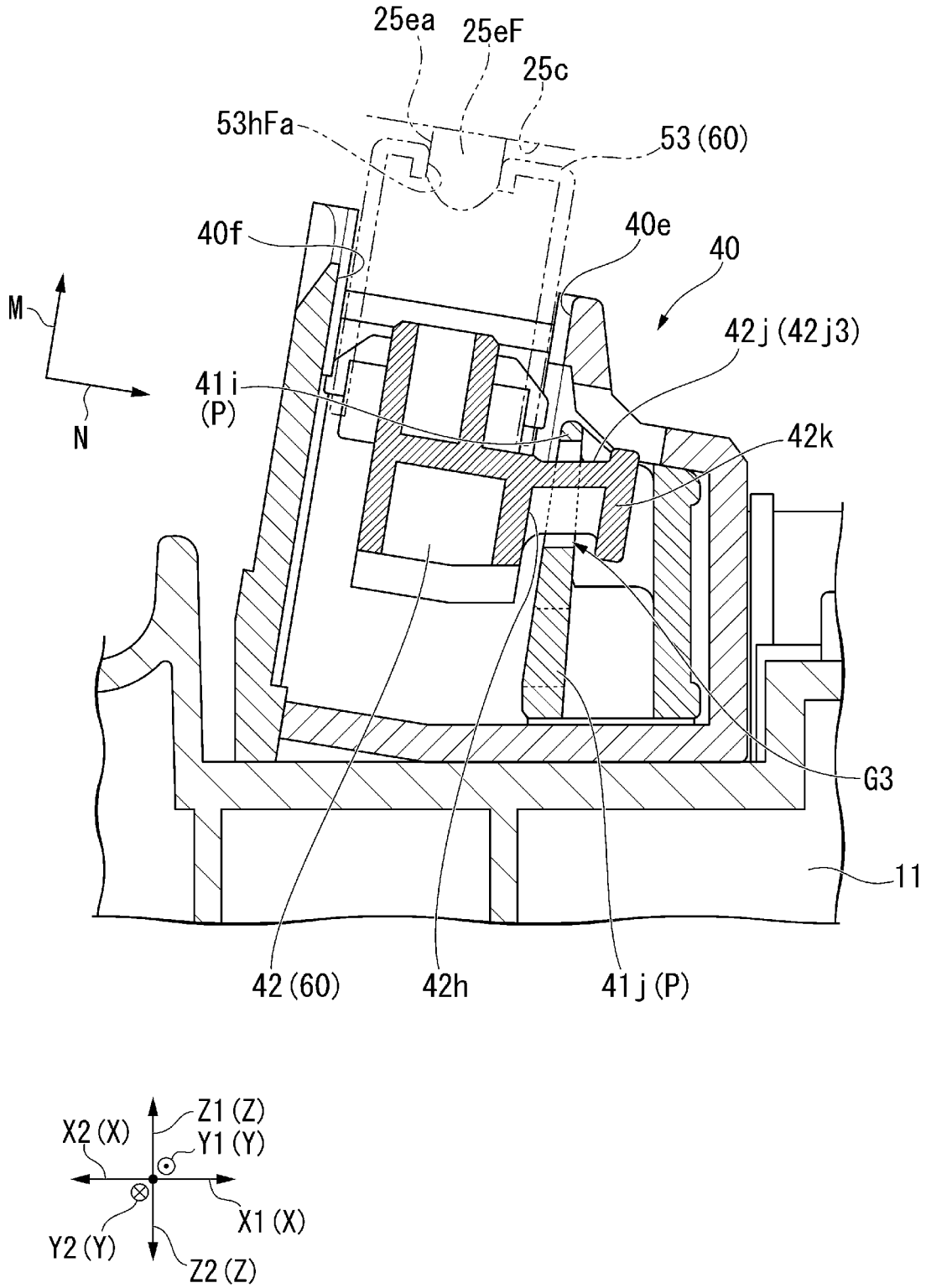
FIG. 19 is another schematic view illustrating the ascending and descending operation of the stage of the moving mechanism.

FIGS. 17, 18 and 19 are schematic views illustrating an ascending and descending operation of the stage of the moving mechanism of the embodiment.

FIG. 17 illustrates a cross section when the stage 60 is in the second position. The first protrusion 42*j* is disposed at the same position as the first protrusion 42*j*1 in FIG. 13. The upper end of the first protrusion 42*j* is locked to the locking portion 41*m*.

Each of the gap between the left side plate 53*b* of the holding member 53 and the inclined surface 40*f* and the gap between the right side plate 53*c* and the inclined surface 40*e* is d.

The distance between the side surface portion 42*h* and the inclined surface 40*e* is w.

The distance between the lowermost end of the surface 42*ka* and the second guide plate 41*j* in the first direction N is a distance 61. The interval between an intersection of the first curved surface 42*ja* and the surface 42*ka* and the first guide plate 41*i* in the first direction N is a distance Δ1. Since the plate thickness of the plate P becomes thinner in accompaniment to advancing in the second direction M, Δ1 is larger than δ1.

By making the magnitudes of w and δ1 smaller than d, the movement range of the stage 60 in the first direction N becomes smaller than d. The smaller w and δ1, the more the position blurring of the stage 60 in the first direction N at the second position can be reduced.

FIG. 18 illustrates a cross section of the stage 60 in the process of moving from the second position to the first position. In FIG. 18, the first protrusion 42*j* is in the same position as the first protrusion 42*j*2 in FIG. 13. The upper end of the first protrusion 42*j* is being abutted on the guide portion 41*n* and is ascending along the inclination of the guide portion 41*n*. The distance between the lowermost end of the second protrusion 42*k* and the second guide plate 41*j* is a distance δ2. The interval between the intersection of the first curved surface 42*ja* and the surface 42*ka* and the first guide plate 41*i* in the first direction N is a distance 42.

Since the plate P becomes thinner in accompaniment to advancing in the second direction M, 62 is larger than δ1 and Δ2 is larger than Δ1.

By making the magnitude of δ2 smaller than d, the movement range of the stage 60 in the first direction N becomes smaller than d. Since δ2 is larger than δ1, the movement range of the stage 60 in the first direction N is larger than that of the stage 60 in the second position.

Since the width of the guide portion 41*n* in the first direction N is narrower than the width of the locking portion 41*m*, an abutment length between the first protrusion 42*j* and the first guide plate 41*i* is smaller than the abutment length at the second position. Since the abutment length between the first protrusion 42*j* and the first guide plate 41*i* gradually decreases as the stage 60 ascends, the frictional force generated between the first protrusion 42*j* and the first guide plate 41*i* gradually decreases.

Since traction force of the stay 42 decreases as the stage 60 ascends, the operating force of the operation unit 46 is reduced.

If the stage 60 ascends in the second direction M, the upper plate 53*a* approaches the first positioning portion 25*e*F. For example, if the axis of the first positioning portion 25*e*F and the central axis of the tubular portion 53*h*F of the second positioning portion 53*h*F are misaligned due to variations in parts, assembly errors during manufacturing, and the like, the first positioning portion 25*e*F cannot be fitted to the tubular portion 53*h*Fa, or a large force is required when fitting the first positioning portion 25*e*F to the tubular portion 53*h*Fa. If the force required when fitting exceeds the urging force of the urging members 44F and 44R, the stage 60 may not be able to ascend before moving to the first position.

In the present embodiment, since the curved portion 53*h*Fb whose diameter is widened upward is provided at the upper end of the tubular portion 53*h*Fa and the tapered portion 25*eb* is formed at the lower end of the first positioning portion 25*e*F, the deviation between the axis of the first positioning portion 25*e*F and the central axis of the tubular portion 53*h*Fa can be absorbed to some extent.

In the present embodiment, as the stage 60 rises, the deviation between the axis of the first positioning portion 25*e*F and the central axis of the tubular portion 53*h*Fa is easily absorbed even at the point that the movement range of the stage 60 in the first direction N is widened.

FIG. 19 illustrates a cross section when the stage 60 is in the first position. In FIG. 19, the first protrusion 42*j* is in the same position as the first protrusion 42*j*3 in FIG. 13.

The columnar portion 25*ea* of the first positioning portion 25*e*F is fitted with the tubular portion 53*h*Fa, and the stage 60 is positioned in the first direction N and Y direction. Since the upper plate 53*a* abuts on the abutment portion 25*f*F, the stage 60 is positioned at the first position in the second direction M.

The first protrusion 42*j* is moved inside the third guide G3 and is separated from the second guide plate 41*j*. Since the external force from the second guide plate 41*j* does not act on the stay 42 through the first protrusion 42*j*, the stage 60 is pressed against the abutment portion 25*f*F by the urging force of the urging member 44F.

Thus, the ascending operation of the stage 60 is described, focusing on the relative operation of the guide member 41A and the first protrusion 42*j* and the relative operation of the first positioning portion 25*e*F and the second positioning portion 53*h*F. The same applies to the relative operation of the guide member 41B and the first protrusion 42*j* and the relative operation of the guide member 41C and the first protrusion 42*j*.

The relative operation of the first positioning portion 25*e*R and the second positioning portion 53*h*R is the same as the relative operation of the first positioning portion 25*e*R and the second positioning portion 53*h*R, except that the second positioning portion 53*h*R does not position in the Y direction of the first positioning portion 25*e*R.

An operation of the image forming apparatus 100 will be described.

First, an image forming operation of the image forming apparatus 100 will be briefly described.

In the image forming apparatus 100 illustrated in FIG. 1, each exposure unit 26 is mounted in the printer unit 3 so that the holding member 53 is in the first position. At the first position, the focal position of the lens 51 is aligned with the surface of the photoreceptor drum 7.

Image formation is started by the operation of the control panel 1 or an external signal. Image information is transmitted to the printer unit 3 by reading an object to be copied by the scanner unit 2, or is transmitted to the printer unit 3 from the outside. The printer unit 3 supplies the sheet S in the sheet supply unit 4 or the sheet S in the manual feed unit 10 to the registration roller 24 based on a control signal generated by the control unit 6 based on the operation of the control panel 1 or the external signal.

If an operation input for image formation is made from the control panel 1, the control unit 6 controls, for example, to start feeding the sheet S and forming an image.

Each exposure unit 26 exposes each of the photoreceptor drums 7 of the image forming unit 25Y, 25M, 25C, and 25K based on image information corresponding to a color transmitted from the control unit 6 to form an electrostatic latent image corresponding to each image information. Each electrostatic latent image is developed by the developing device 8. Therefore, a toner image corresponding to the electrostatic latent image is formed on the surface of each photoreceptor drum 7.

Each toner image is primarily-transferred to the intermediate transfer belt 27 by each transfer roller. As the intermediate transfer belt 27 moves, the toner images are sequentially superposed without causing color shift and delivered to the transfer unit 28.

The sheet S is fed from the registration roller 24 to the transfer unit 28. The toner image that reaches the transfer unit 28 is secondarily-transferred to the sheet S. The secondarily-transferred toner image is fixed to the sheet S by the fixing device 29. With such configuration, an image is formed on the sheet S.

In the image forming apparatus 100, the photoreceptor unit 25D may need to be pulled out from the apparatus for maintenance. The user tilts the operation unit 46 of the moving mechanism 47 toward the Y1 direction to move the stage 60 to the second position. The stage 60 is separated downward from the abutment portions 25*f*F and 25*f*R. The exposure device 43 fixed to the stage 60 also descends together with the stage 60. Since a gap is formed above the upper plate 53*a* and above the lens 51 according to a descending amount of the stage 60, the photoreceptor unit 25D is pulled out in the Y1 direction without interfering with the exposure unit 26.

After maintenance of the photoreceptor unit 25D is completed, the photoreceptor unit 25D is returned to the printer unit 3, and then the operation unit 46 is erected to move the stage 60 to the first position.

For example, the stage 60 is similarly moved to the second position even when cleaning the lens 51. When cleaning of the lens 51 is completed by inserting a cleaning tool on the lens 51 descended to the second position, a cleaner erects the operation unit 46 and moves the stage 60 to the first position.

As described above, according to the image forming apparatus 100 of the present embodiment, since the moving mechanism 47 is provided, the holding member 53 can be switched between the second position and the first position by operating the operation unit 46. Since the operation of the operation unit 46 is only to switch the rotation position around the rotating joint 46*c*, the operation unit 46 can be easily operated.

According to the moving mechanism 47, the thickness of each of the first guide plate 41*i* and the second guide plate 41*j* of the slider 41 becomes thinner in accompaniment to advancing in the second direction M. At the second position, the position blurring of the stage 60 in the first direction Nis reduced. The moving mechanism 47 can stably hold the stage 60 in the second position.

Since the movable range of the stage 60 in the first direction N increases in the vicinity of the first position, for example, even if the axes of the first positioning portions 25*e*F and 25*e*R and the central axes of the second positioning portions 53*h*F and 53*h*R are misaligned due to variations in parts and assembly errors during manufacturing, the first positioning portions 25*e*F and 25*e*R can be smoothly fitted to the second positioning portions 53*h*F and 53*h*R. The moving mechanism 47 can move the stage 60 to the first position accurately and smoothly.

According to the present embodiment, it is possible to provide the moving mechanism 47 and the image forming apparatus 100 that facilitate the positioning of the stage 60 and the operation of the stage 60.

Hereinafter, a modification example of the embodiment described above will be described.

Figure 20:
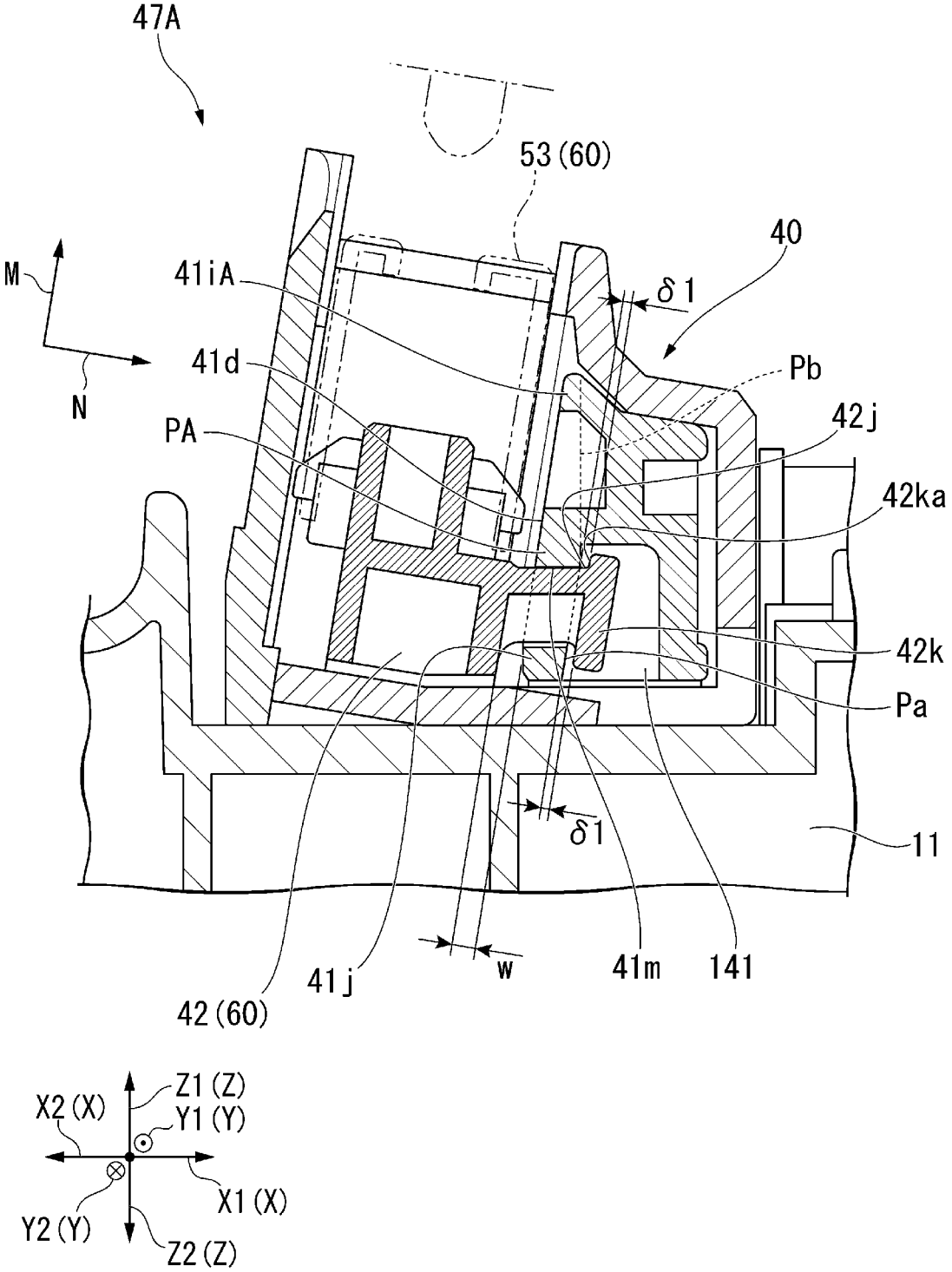
FIG. 20 is a schematic cross-sectional view illustrating a moving mechanism of a first modification example of the embodiment.

FIG. 20 is a schematic cross-sectional view illustrating a moving mechanism of a first modification example of the embodiment.

A moving mechanism 47A of the first modification example illustrated in FIG. 20 includes a slider 141 instead of the slider 41 of the moving mechanism 47 of the embodiment. The moving mechanism 47A can be used in the image forming apparatus 100 instead of the moving mechanism 47.

The slider 141 includes a first guide plate 41*i*A instead of the first guide plate 41*i* of the slider 41.

The first guide plate 41*i*A includes a plate PA instead of the plate P of the slider 41. The plate PA is different from the plate P in that the surface in the first direction N has a side surface Pa parallel to the side surface 41*d* and an inclined surface Pb that approaches the side surface 41*d* in accompaniment to advancing from the upper end of the side surface Pa to the second direction M.

The side surface Pa is formed at a height from the end of the plate PA in the Z2 direction to the locking portion 41*m*.

The inclined surface Pb is formed on the first guide plate 41*i* and the second guide plate 41*j* on the second direction M side of the locking portion 41*m*.

According to the modification example, the distance between the side surface Pa and the surface 42*ka* of the second protrusion 42*k* is δ1. While the second protrusion 42*k* faces the side surface Pa, the movement range of the stage 60 in the first direction N is limited to the ranges of w and δ1.

The distance between the inclined surface Pb and the surface 42*ka* of the second protrusion 42*k* is determined according to an inclination amount of the inclined surface Pb, and gradually decreases from δ1 in accompaniment to advancing in the second direction M.

According to the modification example, since the upper end and the lower end of the second protrusion 42*k* facing the side surface Pa regulate the movement range of the stage 60 in the first direction N, respectively, stability of the position of the stage 60 at the second position is improved.

Figure 21:
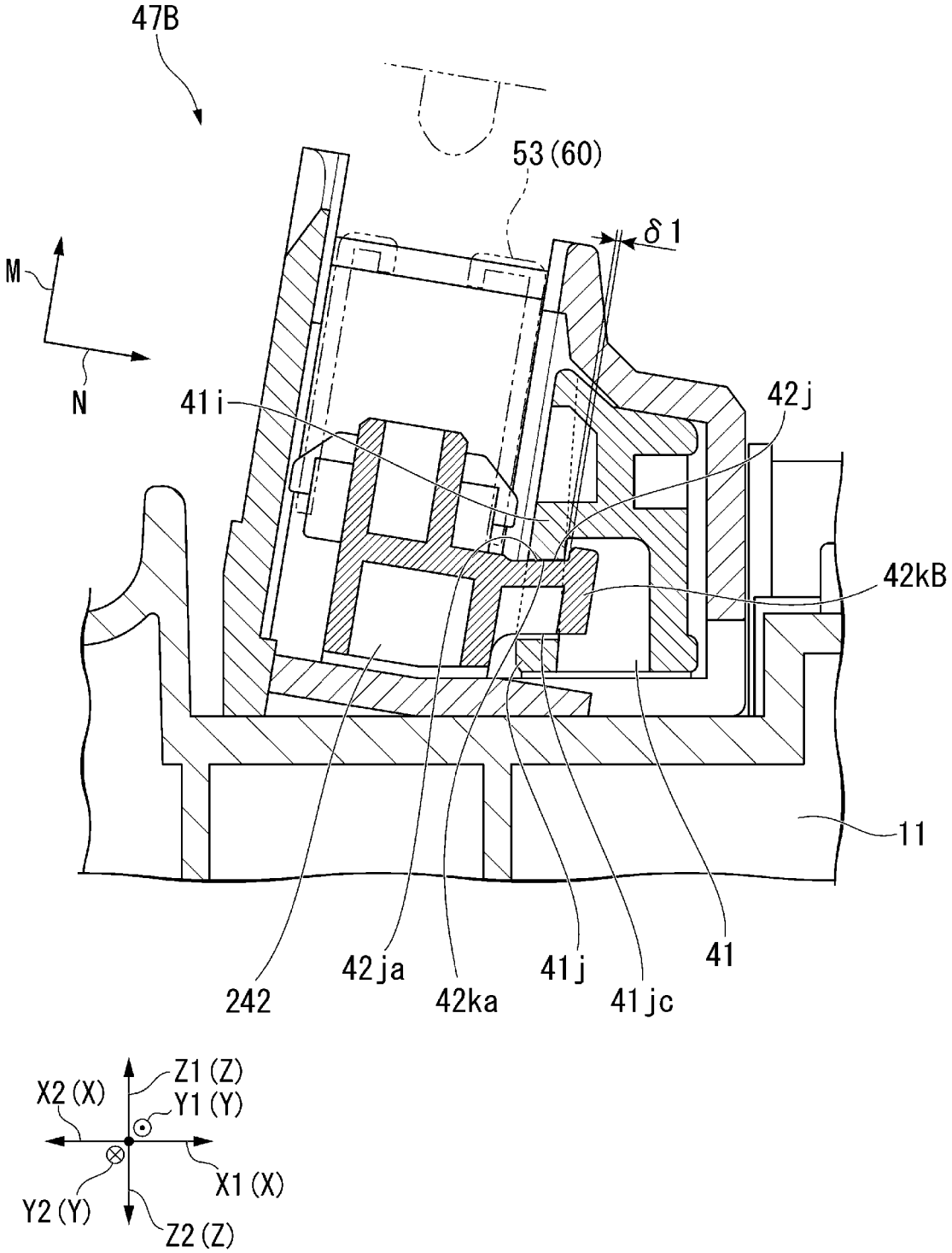
FIG. 21 is a schematic cross-sectional view illustrating a moving mechanism of a second modification example of the embodiment.

FIG. 21 is a schematic cross-sectional view illustrating a moving mechanism of a second modification example of the embodiment.

A moving mechanism 47B of the second modification example illustrated in FIG. 21 includes a stay 242 instead of the stay 42 of the moving mechanism 47 of the embodiment. The moving mechanism 47B can be used in the image forming apparatus 100 instead of the moving mechanism 47.

The stay 242 includes a second protrusion 42*k*B instead of the second protrusion 42*k* of the slider 41.

The second protrusion 42*k*B has a flange shape in which the lower end portion does not protrude further than a second curved surface 42*jp*. The surface 42*ka* of the second protrusion 42*k*B faces the surface of the first guide plate 41*i* on the first direction N side, but does not face the second guide plate 41*j*.

In the modification example, the interval between the intersection of the first curved surface 42*ja* and the surface 42*ka* and the first guide plate 41*i* is set to δ1. Since the second protrusion 42*k*B does not protrude below the second curved surface 42*jc*, even if the interval between the upper end and the first guide plate 41*i* is narrowed as in δ1, the lower end of the second protrusion 42*k*B does not interfere with the second guide plate 41*j*.

The modification example is an example if the second guide plate 41*j* is not used to regulate the movement range of the stage 60 in the first direction N.

According to the modification example, the first guide plate 41*i* and the second protrusion 42*k*B can exert the effect similar to that of the embodiment.

According to the modification example, for example, the second guide plate 41*j* configuring a part of the through-hole G can be deleted if strength is not needed.

In the embodiment and each modification example, the first positioning portion and the second positioning portion are respectively described as the columnar pin and the hole. However, the first positioning portion and the second positioning portion are not limited thereto as long as the first positioning portion and the second positioning portion can be fitted to each other in a concave-convex manner. For example, the second positioning portion may be a columnar pin, and the first positioning portion may be a hole.

A concave portion used for the concave-convex fitting may be a concave portion other than the hole. For example, the concave portion may be a bottomed hole.

As a convex portion used for the concave-convex fitting, pins and protrusions having various cross-sectional shapes other than the column may be used.

In the embodiment and each modification example, the operation unit in the moving mechanism is described as a lever that rotates in the YZ plane. However, the operation unit is not limited to the lever that rotates in the YZ plane as long as the operation to move the guide member in the Y direction is possible.

In the embodiment and each modification example, the example in which the stage of the moving mechanism holds the exposure device and is used for ascending and descending of the exposure device in the image forming apparatus 100 is described. However, a component other than the exposure device may be mounted on the stage. The moving mechanism may be used in equipment other than the image forming apparatus.

According to at least one embodiment described above, by including a stage which has the first and second protrusions and a guide member which reduces the pressure in accompaniment to advancing in the second direction, a moving mechanism and an image forming apparatus that facilitates positioning of the stage and operation of the stage are provided.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a photoreceptor component comprising a photoreceptor configured to carry an electrostatic latent image;

a first terminal configured to be supported by the photoreceptor component;

a stage comprising a second terminal that fits with the first terminal and configured to regulate a relative movement in a first direction with the photoreceptor and to move from a first position closer to the photoreceptor to a second position farther from the photoreceptor in a second direction opposite to the first position so that the second terminal fits with the first terminal;

a first protrusion that protrudes from a base portion provided on the stage in a direction intersecting the second direction;

a second protrusion that protrudes in a direction intersecting the first direction from the first protrusion at a position separated from the base portion in the first direction;

a slider configured to move in a third direction that intersects the second direction and the first direction, in which a thickness of a first position regulation portion in the first direction that regulates a position of the first protrusion in the second direction when the stage is in the first position is thinner than a thickness of a second position regulation portion in the first direction that abuts on the first protrusion when the stage is in the second position, include the first position regulation portion and the second position regulation portion at positions separated from each other in the third direction, and slide with the first protrusion between the base portion and the second protrusion and include a guide portion which is long in the third direction between the second position regulation portion and the first position regulation portion; and an exposure device configured to be supported by the stage and to emit light to draw an electrostatic latent image on the photoreceptor.

2. The image forming apparatus according to claim 1, wherein the thickness of the second position regulation portion in the first direction is a size that fits in a gap between the base portion and the second protrusion.

3. The image forming apparatus according to claim 1, wherein the guide portion is inclined in a direction that diagonally intersects the second direction when viewed from the first direction.

4. The image forming apparatus according to claim 1, wherein the first terminal comprises a shaft member long in the second direction, and the second terminal comprises a tubular portion configured to fit to the first terminal at least in the first direction and a curved portion whose diameter gradually increases from an end of the tubular portion in the second direction toward the second direction.

5. The image forming apparatus according to claim 1, wherein the photoreceptor is a photoreceptor drum.

6. The image forming apparatus according to claim 1, wherein the second terminal fits with the first terminal in a concave-convex manner.

7. The image forming apparatus according to claim 1, wherein the third direction intersects the second direction and the first direction in a perpendicular manner.

8. The image forming apparatus according to claim 1, wherein the first protrusion comprises a columnar portion and a tapered portion.

9. The image forming apparatus according to claim 1, wherein the second protrusion comprises a columnar portion and a tapered portion.

10. The image forming apparatus according to claim 1, wherein the slider has a cross section having a substantially trapezoidal shape.

11. A moving mechanism for an image forming apparatus which includes a photoreceptor configured to carry an electrostatic latent image, a first terminal, and an exposure device that emits light to draw an electrostatic latent image on the photoreceptor, the moving mechanism comprising:

a stage comprising a second terminal that fits with the first terminal and configured to regulate a relative movement in a first direction with the photoreceptor, to move from a first position closer to the photoreceptor to a second position farther from the photoreceptor in a second direction opposite the first position so that the second terminal fits with the first terminal, and to support the exposure device;

a first protrusion that protrudes from a base portion provided on the stage in a direction intersecting the second direction;

a second protrusion that protrudes in a direction intersecting the first direction from the first protrusion at a position separated from the base portion in the first direction; and a slider configured to move in a third direction that intersects the second direction and the first direction, in which a thickness of a first position regulation portion that regulates a position of the first protrusion in the second direction when the stage is in the first position is thinner than a thickness of a second position regulation portion that abuts on the first protrusion in the first direction when the stage is in the second position, include the first position regulation portion and the second position regulation portion at positions separated from each other in the third direction, and slide with the first protrusion between the base portion and the second protrusion and include a guide portion which is long in the third direction between the second position regulation portion and the first position regulation portion.

12. The moving mechanism according to claim 11, wherein the thickness of the second position regulation portion in the first direction is a size that fits in a gap between the base portion and the second protrusion.

13. The moving mechanism according to claim 11, wherein the guide portion is inclined in a direction that diagonally intersects the second direction when viewed from the first direction.

14. The moving mechanism according to claim 11, wherein the first terminal comprises a shaft member long in the second direction, and the second terminal comprises a tubular portion configured to fit to the first terminal at least in the first direction and a curved portion whose diameter gradually increases from an end of the tubular portion in the second direction toward the second direction.

15. The moving mechanism according to claim 11, wherein the photoreceptor is a photoreceptor drum.

16. The moving mechanism according to claim 11, wherein the second terminal fits with the first terminal in a concave-convex manner.

17. The moving mechanism according to claim 11, wherein the third direction intersects the second direction and the first direction in a perpendicular manner.

18. The moving mechanism according to claim 11, wherein the first protrusion comprises a columnar portion and a tapered portion.

19. The moving mechanism according to claim 11, wherein the second protrusion comprises a columnar portion and a tapered portion.

20. The moving mechanism according to claim 11, wherein the slider has a cross section having a substantially trapezoidal shape.

* * * * *